US006616476B1

(12) United States Patent
Moritz et al.

(10) Patent No.: US 6,616,476 B1
(45) Date of Patent: Sep. 9, 2003

(54) ELECTRICAL PLUG-IN CONNECTOR WITH AT LEAST ONE INSULATION DISPLACEMENT CONTACT ELEMENT CONSISTING OF A SHEET METAL STAMPING, AND CORRESPONDING MATING CONNECTOR

(75) Inventors: Werner Moritz, Wuppertal (DE); Roland Wittenberg, Wuppertal (DE); Robert Schneider, Gevelsberg (DE)

(73) Assignee: Grote & Hartmann GmbH Co. KG, Wuppertal (DE)

( * ) Notice: Subject to any disclaimer, the term of this patent is extended or adjusted under 35 U.S.C. 154(b) by 0 days.

(21) Appl. No.: 09/936,211

(22) PCT Filed: Sep. 21, 2000

(86) PCT No.: PCT/EP00/01723

§ 371 (c)(1),
(2), (4) Date: Nov. 8, 2001

(87) PCT Pub. No.: WO00/55943

PCT Pub. Date: Sep. 21, 2000

(30) Foreign Application Priority Data

Mar. 12, 1999 (DE) ..... 199 11 120
Nov. 8, 1999 (DE) ..... 199 53 593

(51) Int. Cl.[7] ..... H01R 11/20

(52) U.S. Cl. ..... 439/404; 439/395; 439/854

(58) Field of Search ..... 439/404, 397, 439/395, 401, 883, 884

(56) References Cited

U.S. PATENT DOCUMENTS 4,046,446 A * 9/1977 Seavis, Jr. ..... 339/99
4,220,390 A * 9/1980 Cobaugh et al. ..... 339/97
4,232,927 A * 11/1980 Stull ..... 339/99
4,527,857 A * 7/1985 Hughes et al. ..... 339/258
4,895,531 A * 1/1990 Vignoli ..... 439/398
5,088,933 A 2/1992 Ribbeck ..... 439/395
5,399,098 A * 3/1995 Marshall et al. ..... 439/398
5,571,029 A 11/1996 Poissant et al. ..... 439/411

FOREIGN PATENT DOCUMENTS

DE 25 19 418 11/1975
DE 78 15 430 U 10/1978

(List continued on next page.)

*Primary Examiner*—Tho D. Ta
*Assistant Examiner*—Truc Nguyen
(74) *Attorney, Agent, or Firm*—Blank Rome LLP

(57) ABSTRACT

The invention relates to an electrical plug connector comprising at least one plug connector housing and at least one insulation displacement contact element that can be plugged into the plug connector housing and comprises a sheet-metal stamping, which element has a contact baseplate, on which, on mutually opposite edges, a first contact plate and a second contact plate are integrally formed in one piece in a manner such that they are bent away in the same direction via a respective bending zone, the contact plates each having an insulation displacement contact device for a conductor wire, and contact-making elements for forming a contact-making device for making releasably pluggable contact with a mating plug contact element being provided on the insulation displacement contact element, in which case at least one contact plate is embodied as a contact arm in which the insulation displacement contact device is accommodated at its bending zone end region and whose free end has at least one element of the contact-making device, and to a mating plug connector having a mating plug connector housing which has a connection region, located in which there is at least one mating insulation displacement contact element for making contact with a conductor wire, and a plug receptacle device for a plug connector, said device being arranged in an extension of the connection region, in which case a contact zone of the mating insulation displacement contact element is formed in the manner of a printed circuit board edge contact element and projects into the plug receptacle device.

49 Claims, 9 Drawing Sheets

FOREIGN PATENT DOCUMENTS

Figure 1:
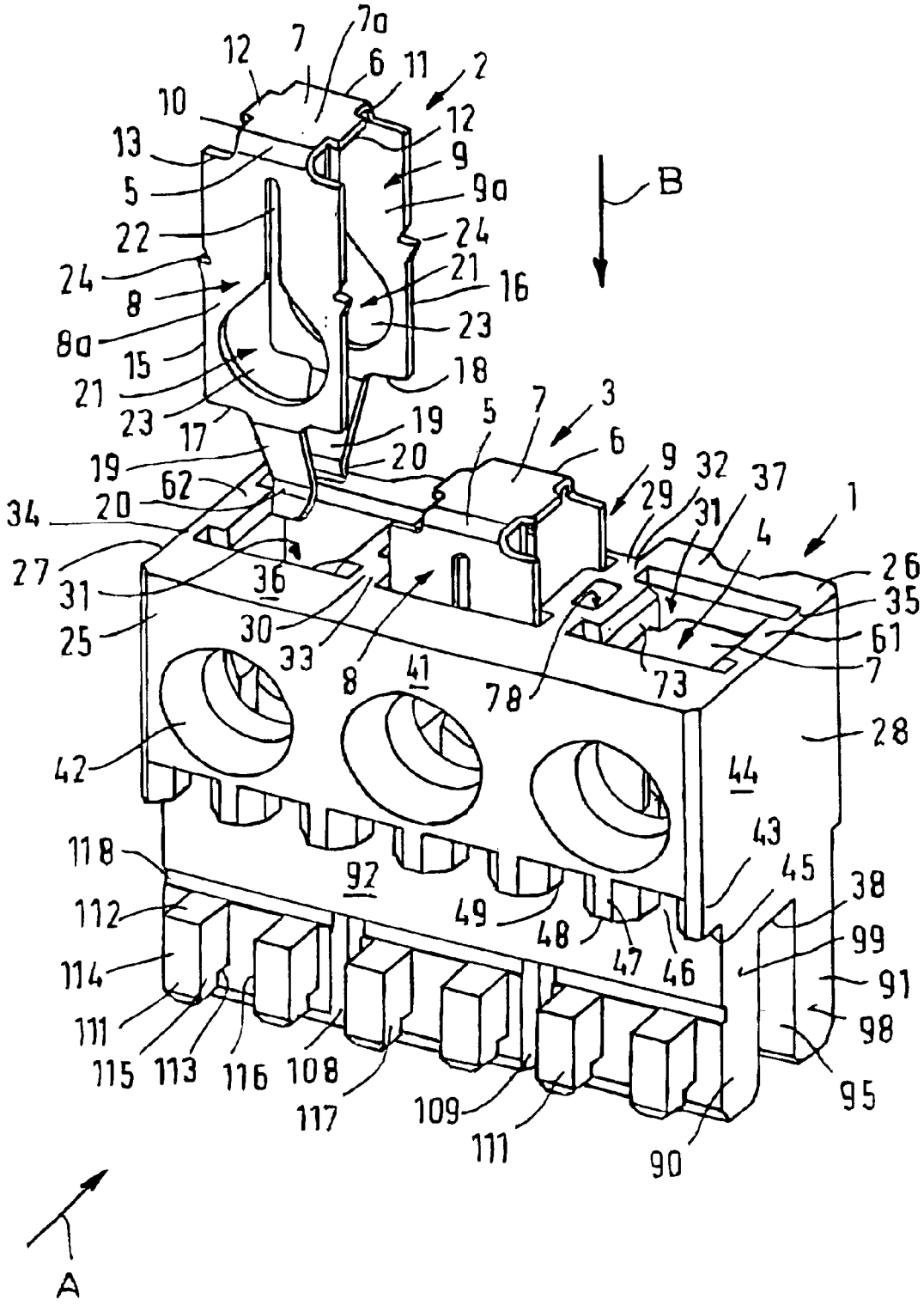

| | | |
|---|---|---|
| DE | 78 15 430 | 10/1978 |
| DE | 85 28 897.7 | 1/1986 |
| DE | 89 01 559.2 | 7/1990 |
| DE | 90 15 110 U | 2/1991 |
| DE | 94 07 659.6 | 10/1994 |
| DE | 43 31 212 C2 | 3/1995 |
| DE | 295 09 233 U | 10/1995 |
| DE | 196 42 445 C1 | 3/1998 |
| DE | 197 53 269 A1 | 6/1999 |
| DE | 299 10 867 U1 | 11/1999 |
| EP | 0 746 055 | 12/1996 |
| GB | 2 198 599 A | 6/1988 |

* cited by examiner

ELECTRICAL PLUG-IN CONNECTOR WITH AT LEAST ONE INSULATION DISPLACEMENT CONTACT ELEMENT CONSISTING OF A SHEET METAL STAMPING, AND CORRESPONDING MATING CONNECTOR

The invention relates to an electrical plug connector having at least one insulation displacement contact element comprising a sheet-metal stamping according to the preamble of claim 1, and to a corresponding mating plug connector according to the preamble of claim 88 [sic]

An electrical plug connector of this type is disclosed in DE-U 78 15 430. A known electrical plug connector of this type has a contact baseplate and two contact plates which are integrally formed in one piece on the contact baseplate on opposite sides and are bent away in the same direction. A respective insulation displacement contact-making device, comprising an insulation displacement contact slot and a feed hole for a conductor wire, is introduced into the contact plates, the insulation displacement contact slot opening into the feed hole. A holding plate having devices for guiding and holding and/or latching the insulation displacement contact element in a plug connector housing is integrally formed in one piece in an extension of a contact plate. Said contact plate is laterally adjoined by contact carrier plates which are bent away at right angles to the contact plate and on whose lower end remote from the insulation displacement contact-making device spring contact straps are integrally formed in one piece.

It is disadvantageous that the insulation displacement contact element has a complicated spatial form which requires a relatively large amount of material and a relatively high shaping complexity. Moreover, the contact spring arms have a relatively hard spring characteristic which, in the case of multipole plug connectors, causes high plugging and pulling forces during the process of plugging and pulling a mating plug connector.

It is an object of the invention to provide an electrical plug connector and a mating plug connector of the type described in the introduction whose insulation displacement contact element is in each case constructed simply and can be formed simply and whose spring characteristic—in the case of a forked spring contact—is designed to be relatively soft.

This object is achieved by means of a plug connector having the features of claim 1 and a mating plug connector having the features of claim 88 [sic]. Advantageous developments of the invention are specified in the subclaims.

Figure 2:
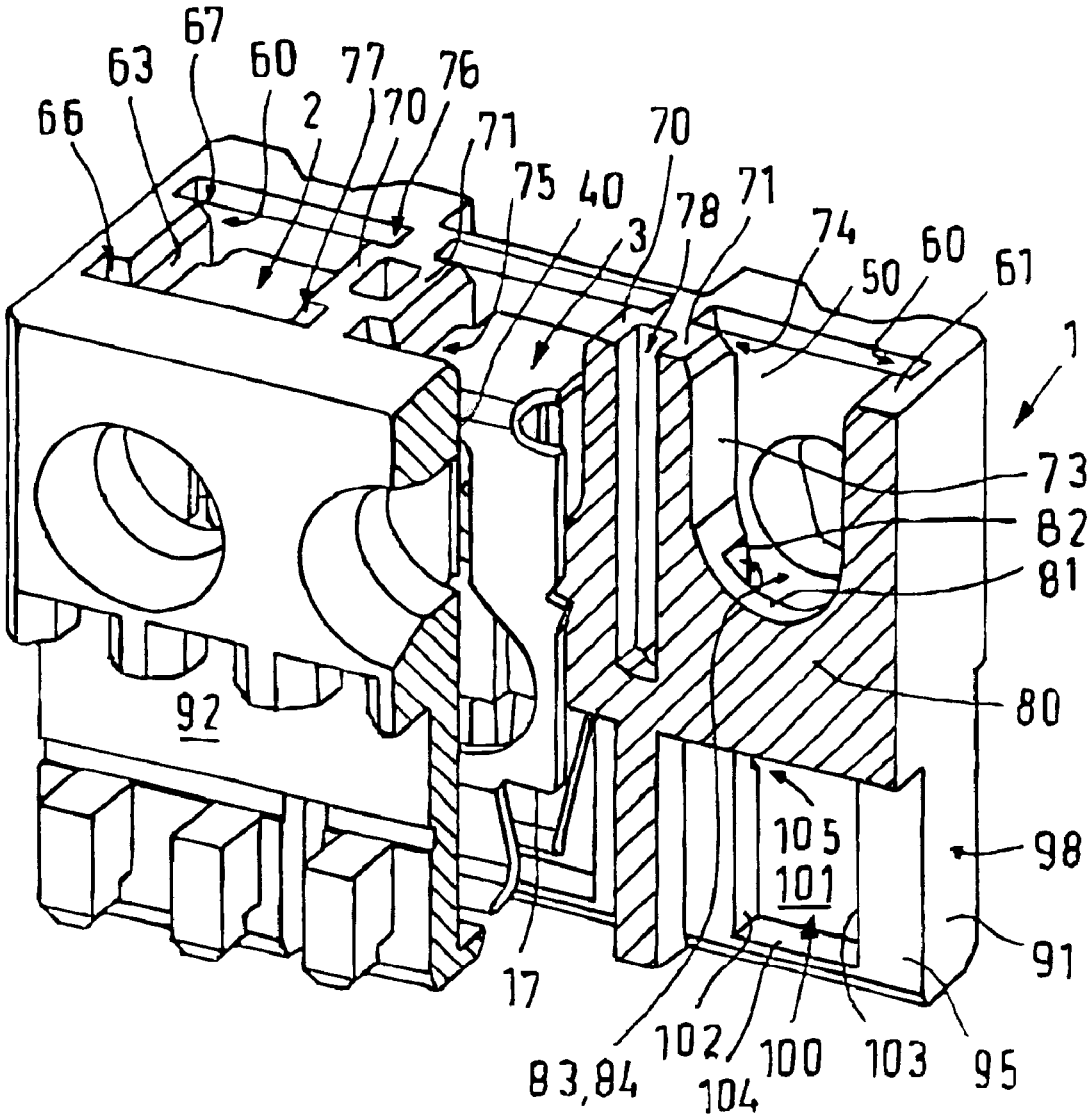
Figure 3:
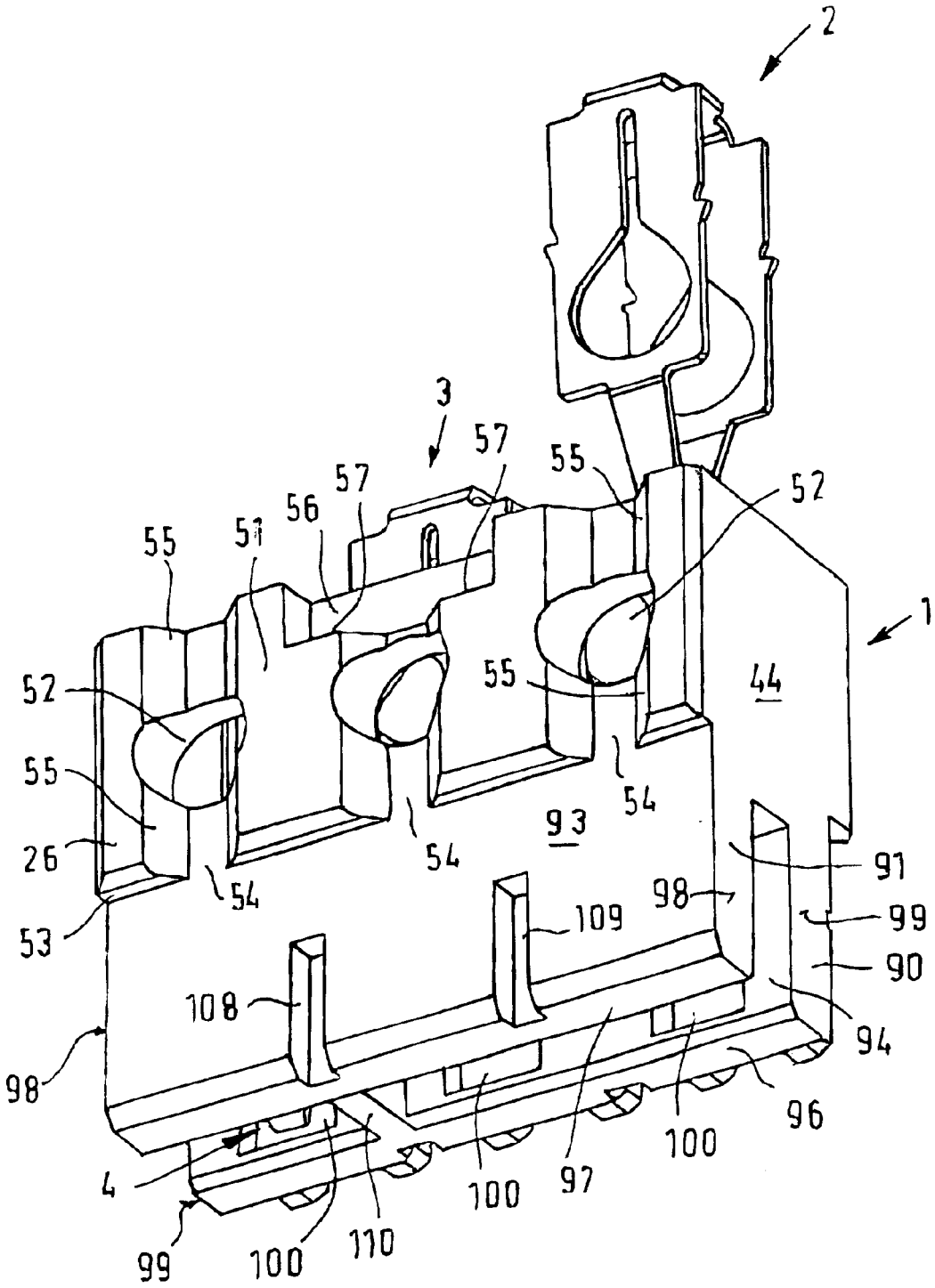
Figure 4:
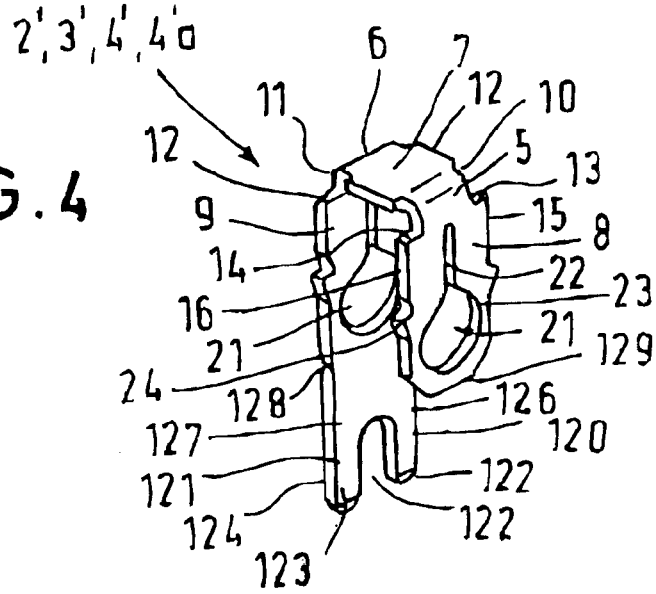
Figure 5:
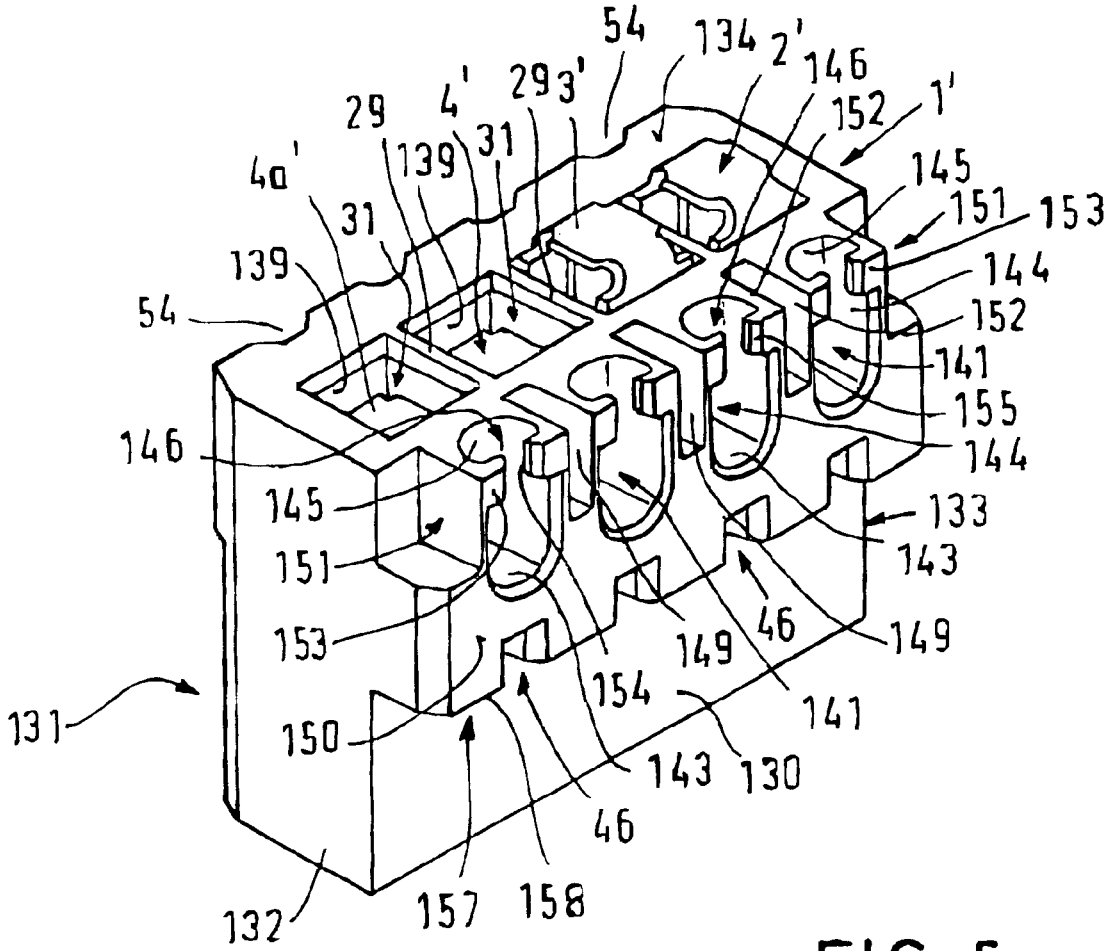
Figure 6:
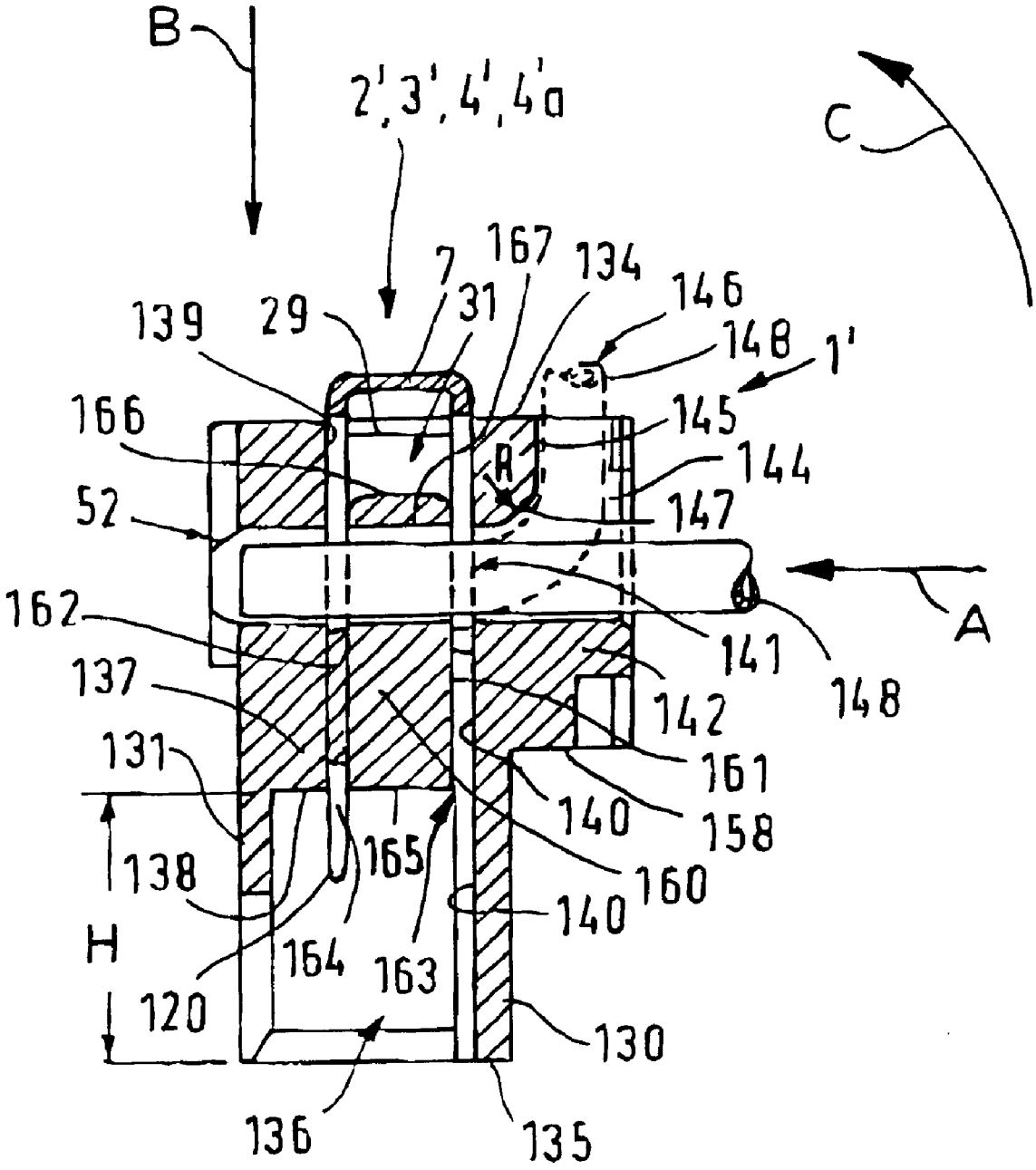
Figure 7:
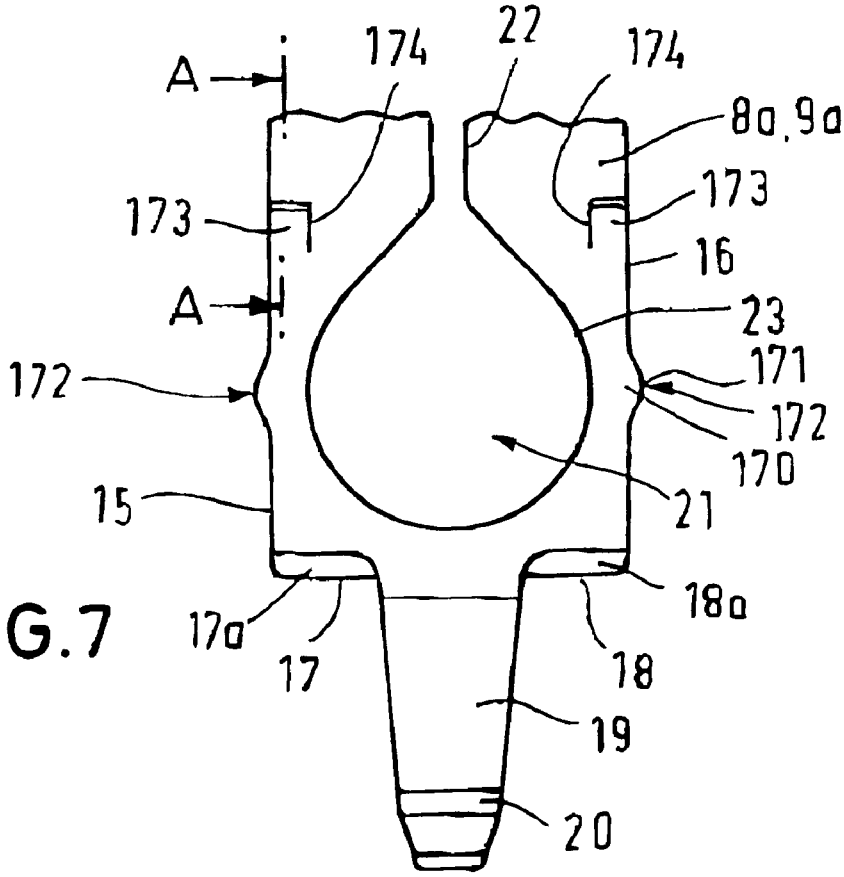
Figure 8:
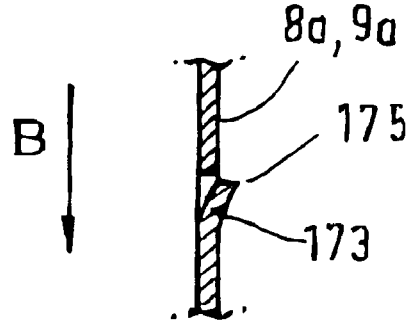
Figure 9:
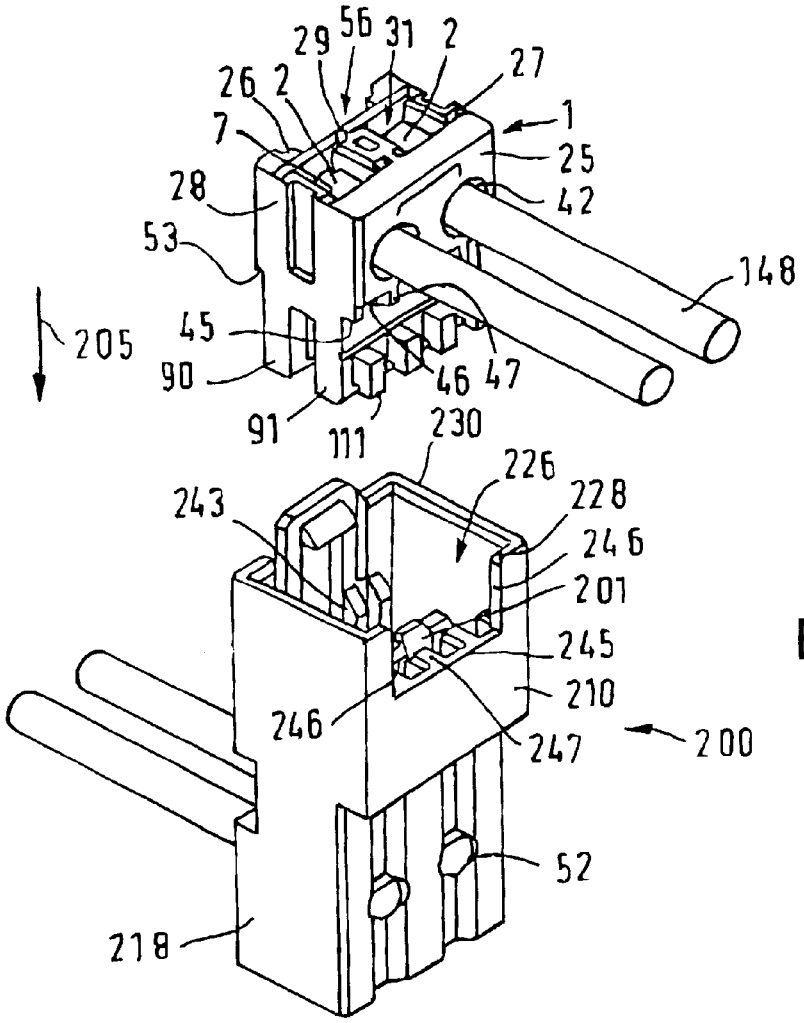
Figure 10:
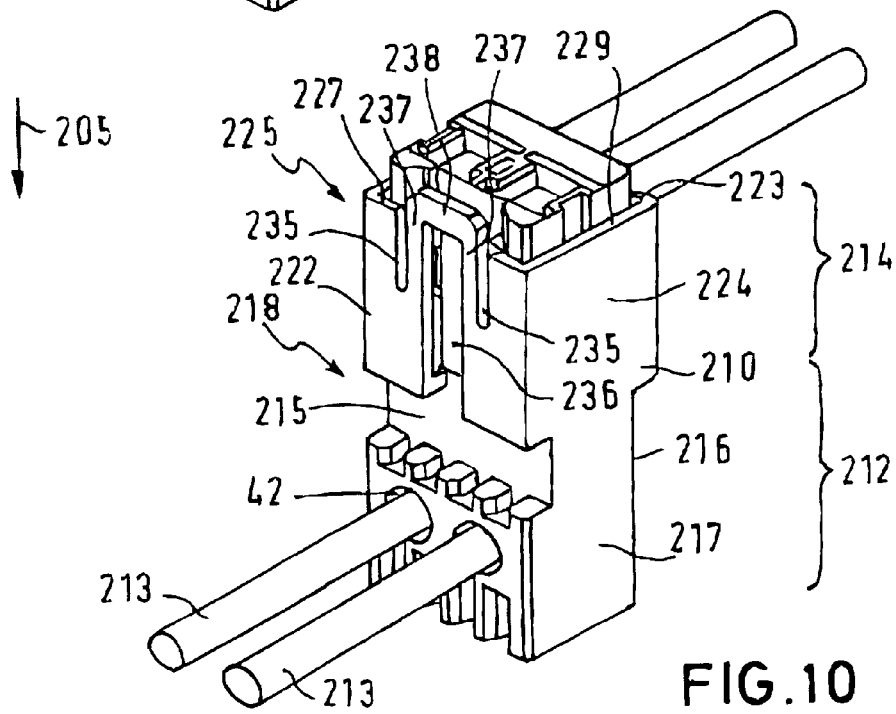
Figure 11:
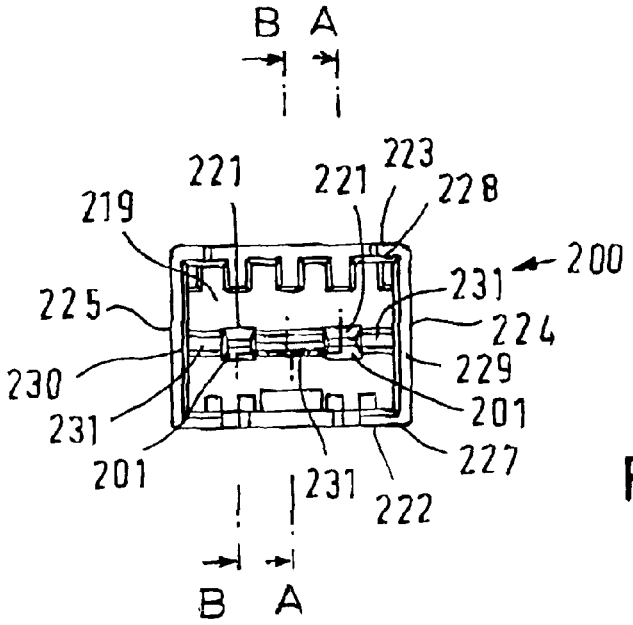
Figure 12:
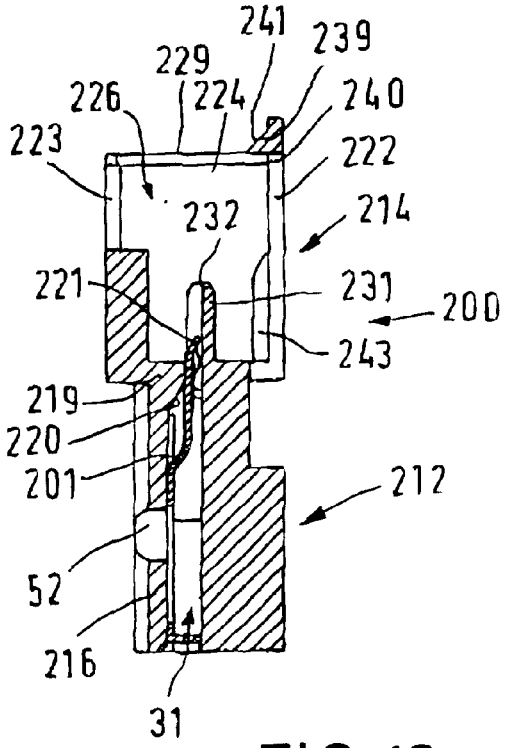
Figure 13:
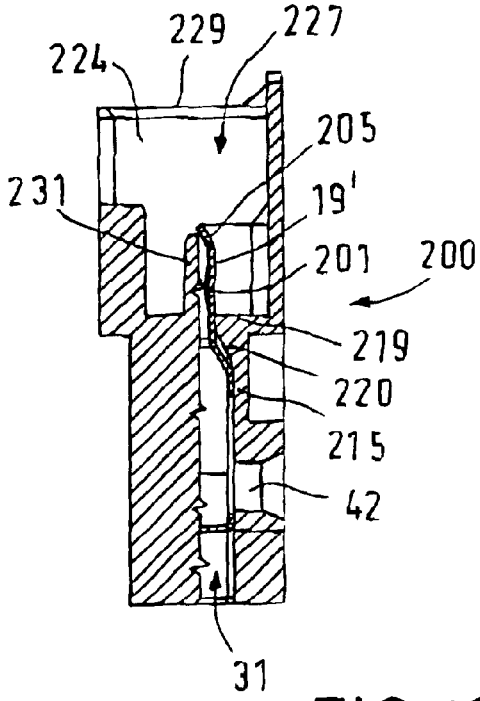
Figure 14:
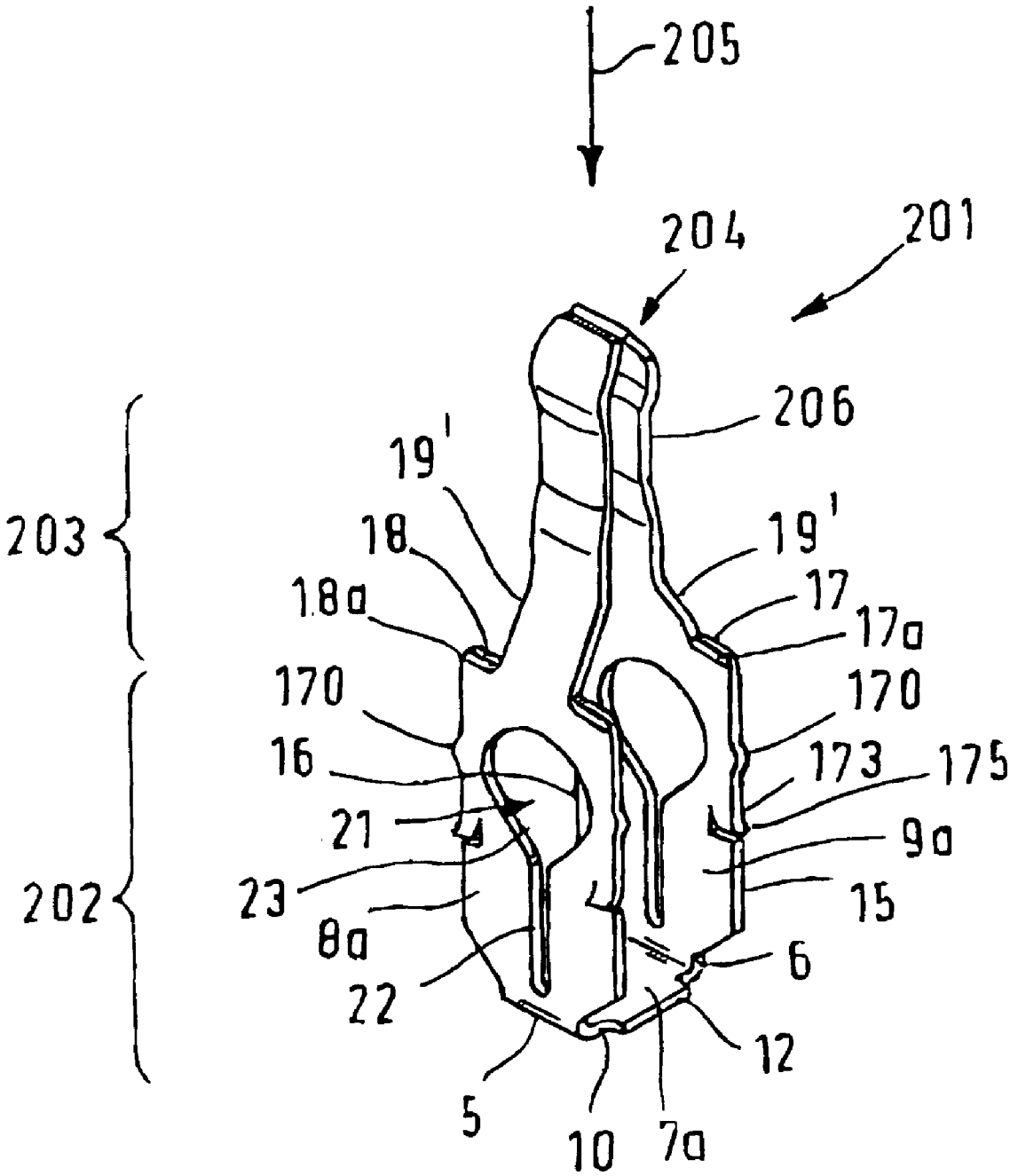

The invention is explained in more detail below by way of example with reference to the drawing, in which:

FIG. 1 shows a perspective plan view of the front side of a first embodiment of a three-pole plug connector according to the invention with a terminally plugged insulation displacement contact element, a preliminarily plugged insulation displacement contact element and an as yet unplugged insulation displacement contact element, FIG. 2 shows a perspective plan view of the three-pole plug connector according to FIG. 1 with a cut-away partial region and with two terminally plugged-in insulation displacement contact elements, FIG. 3 shows a perspective bottom view of the rear side of the three-pole plug connector according to FIG. 1, FIG. 4 shows a perspective view of a second embodiment of an insulation displacement contact element according to the invention, FIG. 5 shows a perspective plan view of the front side of a further embodiment of a four-pole plug connector according to the invention with two preliminarily plugged-in insulation displacement contact elements and one insulation displacement contact element that is not as yet plugged in, FIG. 6 shows a cross section through the plug connector according to FIG. 4, FIG. 7 shows a partial front view of a further embodiment of an insulation displacement contact element in accordance with FIG. 1, FIG. 8 shows a section along the line A—A in FIG. 7, FIG. 9 shows a perspective view of the connection side of a two-pole plug connector according to the invention and also a corresponding mating plug connector in the unplugged state, FIG. 10 shows a perspective view of the connection side of the mating plug connector in accordance with FIG. 9 and also a corresponding mating connector in the plugged state, FIG. 11 shows a plan view of a mating plug connector according to the invention in accordance with FIGS. 9 and 10, FIG. 12 shows a section through a mating plug connector according to the invention along the line A—A in accordance with FIG. 11 with the viewing direction in the direction of the arrow and a preliminarily plugged mating insulation displacement contact element, FIG. 13 shows a section through a mating plug connector according to the invention along the line B—B in accordance with FIG. 11 with the viewing direction in the direction of the arrow and a terminally plugged mating insulating displacement contact element, FIG. 14 shows a perspective view of a mating insulation displacement contact element of a mating plug connector according to the invention.

The three-pole plug connector according to the invention as represented in FIGS. 1 to 3 comprises the plug connector housing 1 made of plastic and insulation displacement contact elements 2, 3, 4 seated in the housing 1.

The insulation displacement contact elements 2, 3, 4 are of identical design. They are formed from a sheet-metal stamped strip which is bent essentially only in a U-shaped manner and is bent away at right angles and in the same direction about two parallel bending zones 5, 6, which lie transversely with respect to the longitudinal extent of the sheet-metal stamped strip and are arranged at a distance from one another, in such a way that a preferably planar contact arm baseplate 7, e.g., in accordance with FIG. 1, a spring arm baseplate 7*a*, is formed, to which, via the bending zones 5, 6, a respective contact arm 8, 9 is integrally connected in one part, which are formed as contact spring arms 8*a*, 9*a* in the exemplary embodiment in accordance with FIG. 1.

The spring arm baseplate 7*a* has free side edges 10, 11 which run at right angles to the two bending zones 5, 6 and in the longitudinal center of which supporting projections 12 are integrally formed.

The contact spring arms 8*a*, 9*a* are constructed identically. In this respect, the represented insulation displacement contact elements 2, 3, 4 are formed mirror-symmetrically with respect to a plane running parallel to the contact spring arms 8*a*, 9*a* and passing transversely centrally through the spring arm baseplate, and a plane passing at right angles thereto longitudinally centrally through the spring arm baseplate 7*a*.

The contact spring arms 8*a*, 9*a* are somewhat wider than the spring arm baseplate 7*a* including the supporting projections 12 and have, on both sides of the bending zone 5, 6, a projecting short end edge 13, 14, longitudinal edges 15, 16 adjoining the end edges 13, 14 at right angles, and short end edges 17, 18 projecting back at right angles, between the latter a respective narrow contact web 19 extending in the longitudinal direction of the contact spring arms 8*a*, 9*a* being formed as a free end region of the contact spring arms 8, 9. The contact webs 19 converge to form a contact point 20, from where they diverge a little in order to form an insertion funnel for a mating contact element (not illustrated). The end edges 17, 18 are preferably provided with chamfers 17*a*, 18*a* across their entire length (cf. FIG. 7).

According to the invention, each contact spring arm 8*a*, 9*a* has, in the region between the bending zone 5, 6 and the contact webs 19, a keyhole-shaped insulation displacement device 21 with a narrow insulation displacement contact slot 22 in the vicinity of the bending zone, which slot runs transversely centrally parallel to the longitudinal edges 15, 16 and opens into a plug-in hole 23 in the vicinity of the contact web.

At least one barbed locking tip 24 projecting over the edge is formed in at least one longitudinal edge 15, 16, the function of which tip is explained in more detail below.

The essentially parallelepipedal plastic or insulating-material housing 1 is embodied for example as a three-pole housing 1 and has a front wall 25 and a rear wall 26 running parallel at a distance from the front wall 25, which in each case extend in a longitudinal direction of the housing 1 (FIGS. 1, 2, 3). In the longitudinal direction, the plug connector housing 1 is bounded by in each case a first side wall 27 and a second side wall 28, which run at right angles to the front and rear walls 25, 26 in a transverse direction, thereby forming a housing interior bounded by the walls 25, 26, 27, 28. In the housing interior, separating webs 29, 30 are arranged parallel to the side walls 27, 28 and divide the housing interior into, for example, three equally sized, upwardly open contact element chambers 31 for receiving a respective one of the insulation displacement contact elements 2, 3, 4. Toward the top, the housing 1 is bounded by upper boundary edges 32, 33 of the separating webs 29, 30, by upper boundary edges 34, 35 of the side walls 27, 28 and by upper boundary edges 36, 37 of the front wall 25 and of the rear wall 26, respectively, all the boundary edges 32, 33, 34, 35, 36, 37 lying in an extending plane.

The front wall 25, the rear wall 26, the side walls 27, 28 and also the separating webs 29, 30 all have the same height extent, which is defined by a respective lower edge 38 of the side walls 27, 28.

The front wall 25 has an external side 41 and a smooth-faced, planar internal side 40 which faces the contact element chambers 31 and on which the contact spring arm 8 of one of the insulation displacement contact elements 2, 3, 4 bears in each case in the mounted state.

The front wall 25 has feed holes 42 which penetrate the front wall 25 approximately in the middle of its height and serve for plugging in a conductor wire with which contact is to be made, each of the holes 42 being assigned to a contact element chamber 31 and, on the inside, in each case opening centrally into said chamber, the feed holes 42 being formed such that they are expanded in a funnel-shaped manner toward the external side 41 of the front wall 25, thereby making it possible to facilitate the feeding of conductor wires. Depending on the conductor wire to be fed in, the diameter of the feed holes 42 is dimensioned to be somewhat larger than the diameter of the conductor wire together with its insulation.

In the longitudinal direction, the front wall 25, with its longitudinal end edges 43, in each case terminates flush with the side walls 27, 28, with the result that the housing 1 is longitudinally bounded by plane lateral external areas 44. The corner region between the external side 41 and the lateral external area 44 is preferably chamfered.

In the lower end region of the front wall 25, the thickness of the front wall 25 is reduced, for example halved, from the external side 41 over the entire longitudinal extent, thereby forming a stop step 45. The stop step 45 is interrupted by crenellated cutouts 46 which are spaced apart uniformly from one another and point a little upward in the direction of the funnel-shaped regions of the holes 42. Consequently, in accordance with their number, the cutouts 46 form stop lugs 47 which are delimited by an end area 48 on the underside.

The stop lugs 47 are in each case delimited by side areas 49 in the longitudinal direction, the transition from the side areas 49 toward the external side 41 in each case being chamfered. The stop lugs 47 are arranged for example in such a way that each stop lug 47 is arranged centrally in the longitudinal direction below a respective one of the feed holes 42 and a further stop lug 47 is in each case arranged centrally between two stop lugs 47 arranged in this way, with the result that the stop lugs 47 are arranged such that they are uniformly spaced apart from one another across the longitudinal extent of the housing 1. In this case, the longitudinal extent of a stop lug is approximately equal to the longitudinal extent of one of the cutouts 46.

The rear wall 26 (FIGS. 2, 3) in each case has an external side 51 and a planar, smooth-faced internal side 50 which faces the contact element chambers 31 and on which one of the insulation displacement contact elements 2, 3, 4 bears in each case in the mounted state of the contact spring arm 9*a*. The rear wall 26 has approximately the same thickness as the front wall 25.

In a manner corresponding to the feed holes 42 in the front wall 25, the rear wall 26 in each case has plug holes 52 for plugging in the conductor wires that are to be plugged in through the feed holes 42. The plug holes 52 preferably have the same diameter as the feed holes 42.

In the lower end region of the rear wall 26, the thickness of said rear wall is reduced, for example halved, from the external side 51—in a manner comparable to the front wall 25—over its entire longitudinal extent, thereby forming a step 53 which, with regard to the housing 1 in height terms, is preferably at the same height as or somewhat higher than the stop step 45.

The external side 51 has, in the longitudinal direction, respective channel-shaped cutouts 54 at the level of the plug holes 52, which cutouts extend vertically upward from the step 53 across the holes 52 and, in the region above the holes 43, have obliquely arranged, plane boundary sidewalls 55 and thus have a trapezoidal cross sectional form.

In the region between the step 53 and the plug holes 52, the boundary sidewalls 55 of the cutouts 54 have a cross-sectionally concave cross sectional form.

A little above the middle plug hole 52, a parallelepipedal latching cutout 56 is introduced into the rear wall 26, which latching cutout penetrates about half way into the rear wall 26, with regard to its thickness, and reaches as far as the upper boundary edge 37 and has a longitudinal extent which corresponds approximately to the longitudinal extent of a contact element chamber 31. The latching cutout 56 forms a latching edge 57, around which, by way of example, a latching arm—fitted on a mating plug housing (cf. FIGS. 9–13)—with a latching lug can engage in a latching manner.

In the same way as the external side 41 of the front wall 25, the external side 51 of the rear wall 26 is chamfered toward the lateral external area 44.

The first and second side walls 27, 28 (FIGS. 1, 2), which, with their lateral external area 44, bound the housing 1 in its longitudinal extent, are constructed identically and arranged mirror-symmetrically. They have an internal side 60 facing the outer contact element chambers 31 and extend in the transverse direction from the internal side 40 of the front wall 25 to the internal side 50 of the rear wall 26.

Centrally in the transverse direction, the side walls 27, 28 have a respective rectangular thickened portion 61, 62 running in the transverse direction, which thickened portions extend approximately over half the transverse extent of the side wall 27, 28 and reach from the upper boundary edges 29, 30 as far as the lower edges 38 of the side walls 27, 28.

The thickened portions 61, 62 each have an internal area 63 facing the contact element chambers 31 and side areas running at a distance from and parallel to the internal sides 40, 50 and bounding the thickened portions 61, 62 in the transverse direction, with the result that a narrow plug groove 66, 67 is in each case formed between the internal sides 40, 50 and the side areas.

The separating webs 29, 30, which each separate two adjacent contact element chambers 31 from one another in the transverse direction and each have two separating areas 74, 75 respectively facing a contact element chamber 31, have, analogously to the side walls 27, 28, toward each of the adjoining contact element chambers 31, a thickened portion 70, 71, which have the same height extent and the same extent in the transverse direction as the thickened portions 61, 62 of the side walls 27, 28. Each of the thickened portions 71, 72 has, analogously to the thickened portions 61, 62, an internal area 73 respectively facing a contact element chamber 31, and two side areas which bound the thickened portions in the transverse direction, are arranged parallel to the internal sides 40, 50 and are arranged identically spaced apart parallel to the internal sides 40, 50 of the front wall 25 and of the rear wall 26 and thus form plug grooves 76, 77 which have the same spatial form as the plug grooves 66, 67. Consequently, each contact element chamber 31 has a cross-sectionally H-shaped spatial form.

Respectively mutually opposite internal areas 73 and 63, and 73 and 73 [sic], in a contact element chamber 31 are at a distance from one another in the longitudinal direction which is equal to or slightly greater than the distance between the boundary edges of the supporting projections 12 of the insulation displacement contact elements 2, 3, 4, with the result that the insulation displacement contact elements 2, 3, 4, in the mounted state, i.e. in the terminally plugged state, are guided in the longitudinal direction in a positively locking manner between two thickened portions of the contact element chambers 31.

The distance between an internal side 60 and an opposite separating area 74 or a separating area 75, respectively, is dimensioned in such a way that an insulation displacement contact element 2, 3, 4 can be plugged in with its longitudinal edges 15, 16 in a manner free from play or with a slight degree of play, but the locking tips 24 penetrate a little into the housing material in an interlocking manner and the insulation displacement contact element 2, 3, 4 is thus held in a positively locking manner and captively, as soon as the locking tips 24 come into contact with separating areas 74, 75 and internal sides 60.

All the upper boundary areas 32, 33, 34, 35, 36, 37 and also the upper edges of all the thickened portions 61, 62 and 70, 71, respectively, are in each case chamfered toward the contact element chambers 31, thereby forming an insertion funnel for an insulation displacement contact element 2, 3, 4.

In the center between two thickened portions 70, 71 of a separating web 29, 30, a blind hole cutout 78 is introduced, for production engineering reasons, in order to avoid material accumulations, which cutout reaches vertically from the top to a point just above the lower edges 38 and is approximately square in cross section.

In the transverse direction centrally from the level of the lower edge 38 up to about half the height of the thickened portions 61, 62, 70, 71, a thin-walled web 80 runs between said thickened portions 61, 62, 70, 71, connecting them, the upper boundary edge 81 of which web is formed such that it is half-round, concave and aligned with the feed holes 42 of the front wall 25 and the plug holes 52 in the rear wall 26. In its configuration of this type, the web 80 serves as a conductor stopper, in particular as a conductor stopper web 80 which, in the mounted state of the insulation displacement contact elements 2, 3, 4, ends up between the contact spring arms 8*a*, 9*a*. The thickness of the conductor stopper web 80 is dimensioned in such a way that, between the conductor stopper web 80 and the internal walls 40 and 50 of the front wall 25 and rear wall 26, respectively, a sufficiently large distance remains for plugging through the bent-away contact webs 19 of the insulation displacement contact elements 2, 3, 4.

In the transverse direction on both sides of the conductor stopper web 80, the thickened portions 61, 62, 70, 71 have vertical material projections 82 which project into the contact element chambers 31 and reach approximately from the level of the upper boundary edge 81 as far as the lower edge 38 and, on their internal sides, each have opposite boundary areas 83, 84 that are spaced apart parallel (FIG. 2).

A front plug cheek 90 and a rear plug cheek 91 are integrally formed in an extension of the front wall 25 and of the rear wall 26, respectively, on the latter in a manner running downward from the level of the lower edge 38. The plug cheeks 90, 91 of the front wall 25 and of the rear wall 26, respectively, have an external side 92, 93 which are aligned with the external side 41 and the external side 51, respectively, in the region below the stop step 45 and the step 53, respectively. The plug cheeks 90, 91 have an internal side 94, 95 which runs parallel to the longitudinal direction and is in each case arranged inwardly offset a little in the transverse direction relative to the internal side 40 of the front wall 25 and the internal side 50 of the rear wall 26, respectively. The interspace between the internal sides 94, 95 of the plug cheeks 90, 91 serves as a plug slot for mating plug elements such as e.g. printed circuit card edge elements.

The plug cheeks 90, 91 are bounded at the bottom by a respective lower boundary edge 96, 97, the boundary edges 96, 97 lying in a common extending plane. In the longitudinal direction, the plug cheeks 90, 91 each have lateral boundary edges 98, 99 which are aligned with the lateral external areas 44 of the side walls 27, 28.

The internal sides 94, 95 of the plug cheeks 90, 91 each have, centrally in the longitudinal direction with respect to a contact element chamber 31, a pocket-like, parallelepipedal shallow depression 100 which in each case reaches from the level of the lower edge 38 to a point just above the lower boundary edge 96 and 97, respectively.

The pocket-shaped shallow depression 100 has a bottom area 101 and vertically running lateral boundary areas 102, 103 and also a horizontally running narrow-side boundary area 104. The bottom area 101 of each pocket-shaped shallow depression 100 adjoins the internal sides 40 and 50, respectively, of the front wall 25, 26 in an aligned manner. The lateral boundary areas 102, 103 are aligned with the corresponding boundary areas 83, 84 of the material projections 82 and reach on a level just below the lower edge 38 in the transverse direction from the internal sides 94, 95 of the plug cheeks 90, 91 as far as the bottom area 101, with the result that a lower stop area 105 is in each case formed on this level, which terminate the plug-in grooves 66, 67 at the bottom and serve as a vertical stop for the insulation displacement contact elements 2, 3, 4, in which case they come into contact with the end edges 17, 18 of the insulation displacement contact elements 2, 3, 4 in the terminally plugged state.

Cutouts 108, 109 that are narrow-slot-shaped in the longitudinal direction are introduced on the external sides 92, 93 of the front and rear plug cheeks 90, 91, in each case at the level of the separating webs 29, 30 in the longitudinal direction, which cutouts extend in a downwardly open manner vertically from the lower boundary edges 96, 97 over about ⅔ of the height of the plug cheeks 90, 91 and have a depth of about half the material thickness of the plug cheeks 90, 91.

The slots 108, 109 serve for example for positioning the housing 1 in the longitudinal direction when the housing 1 is plugged into a mating plug connector.

In order to facilitate the process of plugging the housing 1 into a mating plug connector (cf. FIGS. 9–13), the external sides 92, 93 are in each case chamfered toward the lower boundary edges 96, 97.

In order to stabilize and stiffen the plug cheeks 90, 91 in the transverse direction, a supporting web 110 which connects the plug cheeks 90, 91 in the transverse direction is integrally formed in the longitudinal direction at the level of the separating web 29, which supporting web terminates flush with the lower boundary edges 96, 97. By virtue of the asymmetrical arrangement of the supporting web 110, the latter can serve as polarity reversal protection or anti-rotation protection against the housing 1 being plugged incorrectly into a corresponding mating plug connector. outwardly protruding coding lugs 111 are integrally formed in the region of the lower third of the external side 92 of the front plug cheeks 90. With regard to the longitudinal extent of the housing 1, by way of example, in each case two coding lugs 111 per contact element chamber 31 are integrally formed preferably in such a way that they are aligned in the vertical direction with the cutouts 46 in the front wall 25.

The coding lugs 111 are embodied such that they are essentially parallelepipedal and each have an upper side 112, a lower side 113, an external side 114 running parallel to the external side 92 of the front plug cheeks 90, and two lateral boundary areas 115, 116 which are arranged parallel to one another and bound the coding lugs 111 in each case in their longitudinal extent. At a distance from the external areas 92 of the plug cheeks 90, the coding lugs 111 are embodied such that they are lengthened on the underside, thereby producing a hook-like spatial form for the coding lugs 111. The lengthened portion 117 on the underside is chamfered on all sides in its edge regions.

Directly above the upper sides 112 of the coding lugs, a shallow longitudinal groove 118 which runs over the entire external side 92 in the longitudinal direction and is preferably rectangular in cross section is introduced into the external side 92 of the plug cheeks 90.

For the coding of a housing 1 according to the invention, one or more coding lugs 111 are separated from the housing 1, with the result that the remaining lugs 111 form a predeterminable coding pattern. During the mechanical separation of the coding lugs 111, the longitudinal groove 118 serves as a desired tear-off point for the coding lugs 111, thereby avoiding damage to the remaining surface of the front plug cheek 90.

The method of operation and the assembly sequence of such a plug connector according to the invention are explained briefly below.

In an initial state, the plug connector housing 1 and the insulation displacement contact elements 2, 3, 4 are each present as individual parts (FIG. 1, left). In a first step, the insulation displacement contact elements 2, 3, 4, with the contact webs 19 in front, are plugged from above (direction of arrow B) into a respective contact element chamber 31, the contact spring arms 8*a*, 9*a* being inserted with their longitudinal edges 15, 16 in each case into the plug grooves 66, 67 and 76, 77, respectively. The insertion of the insulation displacement contact elements 2, 3, 4 is preferably done in an automated manner and is effected as far as a preliminarily plugged position of the insulation displacement contact element at which the plug-in holes 23 of the two contact spring arms 8*a*, 9*a* are aligned with the feed holes 42 and the plug holes 52 in the plug connector housing 1. In this position, the locking tips 24 already interlock in an upper region of the plug grooves 66, 67 and 76, 77, respectively, with the result that, in the further assembly sequence, the insulation displacement contact elements 2, 3, 4 are held in a positively locking manner and captively in the preliminarily plugged-in position (FIG. 1, center). It is optionally possible for each contact element chamber 31 of a plug connector housing 1 or only selected contact element chambers 31 to be equipped with insulation displacement contact elements 2, 3, 4.

In a second step, a plug connector prefabricated in this way is equipped with free ends of conductor wires. In this case, the conductor wire ends are respectively inserted through the feed holes 42 and plugged in as far as the plug hole 52 of the rear wall 26, so that the conductor wire end does not project beyond the external side 51 of the rear wall 26 (direction of arrow A). In this position, the conductor wire end region of a conductor wire in each case lies on the U-shaped boundary areas 81 of the conductor stopper webs 80 and the respective lower regions of the holes 42, 52 (FIG. 1, right, FIG. 2, center).

Once all the contact element chambers 31 have been equipped with conductor wires in the desired manner, then all the insulation displacement contact elements 2, 3, 4 are pressed, preferably simultaneously, into their terminally plugged-in end position until the end edges 17, 18 of the insulation displacement contact elements 2, 3, 4 bear on the stop areas 105 at the lower ends of the plug grooves 66, 67 and 76, 77, respectively, of the plug connector housing 1. This assembly step can advantageously likewise be carried out in an automated manner.

In the course of the above-described process of pressing in the insulation displacement contact elements 2, 3, 4, the boundary edges of the insulation displacement contact slots 22 penetrate, in a known manner, the plastic insulation of the conductor wires and make clamping contact with the multiple stranded wires of the conductor wires. Furthermore, the locking tips 24 interlock in this position on or in the side walls 60 and 74, respectively, of the contact element chambers 31.

In addition, the contact webs 19 of the insulation displacement contact elements 2, 3, 4 thus end up below the lower edge 38 and thus project a little, in the transverse direction of the plug connector housing, into the plug slot formed by the plug cheeks 98, 99. The pocket-shaped cutouts 100 in the plug cheeks 90, 91 allow the contact webs 19 to bend back resiliently during the plugging operation with a mating plug connector.

After the conductor wire contact-making process, a predeterminable coding pattern can be produced on the plug connector housing 1 by separating one or more coding lugs 11.

In a plug connector assembled in this way, the conductor wires are mechanically fixed and electrically contact-connected reliably and process-securely. In this embodiment of the plug connector according to the invention, the conductor wires leave the plug connector housing 1 perpendicularly to the plugging direction B of the plug connector.

A four-pole electrical plug connector according to the invention in a second embodiment in accordance with FIGS. 4, 5, 6 comprises a plug connector housing 1' made of plastic and insulation displacement contact elements 2', 3', 4', **4*a*' seated in the housing 1'. In accordance with the second embodiment, the electrical plug connector according to the invention has in many regions essentially the same construction as the electrical plug connectors described above, and so parts of the housing 1' and parts of the insulation displacement contact elements 2', 3', 4', 4*a*'** with the same spatial form and the same function are identified by the same reference symbols.

The insulation displacement contact elements 2', 3', 4', **4*a*' (FIG. 4) are of identical design. They are formed from a sheet-metal stamped strip which is bent essentially only in a U-shaped manner and is bent away at right angles and in the same direction about two parallel bending zones 5, 6, which lie transversely with respect to the longitudinal extent of the sheet-metal stamped strip and are arranged at a distance from one another, in such a way that a preferably planar contact arm baseplate 7 is formed, to which, via the bending zones 5, 6, a first front contact arm 8 and a second rear contact arm 9** are integrally connected in one part.

The contact arm baseplate 7 has free side edges 10, 11 which run at right angles to the two bending zones 5, 6 and in whose longitudinal center supporting projections 12 are integrally formed.

The contact arms 8, 9 are constructed identically in their upper half in the bending zone. In this respect, the represented insulation displacement contact elements 2', 3', 4', **4*a*' are formed in this region mirror-symmetrically with respect to a plane running parallel to the contact arms 8, 9 and passing transversely centrally through the contact arm baseplate 7**, and a plane passing at right angles thereto longitudinally centrally through the contact arm baseplate.

The contact arms 8, 9 are somewhat wider than the contact arm baseplate 7 including the supporting projections 12 and have, on both sides of the bending zone 5, 6, a projecting short end edge 13, 14, and longitudinal edges 15, 16 adjoining the end edges 13, 14 at right angles.

According to the invention, by way of example, the second, rear contact arm 9 has, at its free end, a forked contact-making device 119 extending in the longitudinal direction of the contact arm 9 in the extending plane thereof and preferably comprising two contact pins 120, 121 formed by a downwardly open slot cutout 122 in the contact arm 9. The free ends of the contact pins 120, 121 in each case have chamfers 125 on their front sides 123 and on their rear sides 124, said chamfers making it possible to facilitate the plugging of the insulation displacement contact elements 21, 31, 4', **4*a*' into a mating plug contact element (not shown). In the transverse direction of the insulation displacement contact element, the contact-making device 119 is bounded by two longitudinal edges 126, 127, the longitudinal edges 126, 127 being inwardly offset a little relative to the longitudinal edges 15, 16 in the transverse direction of the insulation displacement contact element, with the result that small projections 128 are formed. At the level of the projections 128, the first, front contact arm 8 is bounded by an end edge 129 on the underside and is chamfered at the corner regions between the end edge 129 and the lateral longitudinal edges 15, 16**.

According to the invention, each contact arm 8, 9 has, in the region between the bending zone 5, 6 and the lower end edge 129 and, respectively, the projections 128, a keyhole-shaped insulation displacement device 21 with a narrow insulation displacement contact slot 22 in the vicinity of the bending zone, which slot runs transversely centrally parallel to the longitudinal edges 15, 16 and opens into a plug-in hole 23 at its end remote from the bending zone 5, 6.

In at least one longitudinal edge 15, 16, at least one locking tip 24 is formed which is again hook-shaped and projects beyond the edge.

The plug connector housing 1' according to the invention (FIGS. 5, 6) has a front wall 130, a rear wall 131 and two side walls 132, 133, which are bounded on the top side by a planar boundary area 134 and, on the underside, form a planar, essentially rectangular lower edge 135.

From the lower edge 135 up to a height H, which approximately corresponds to half the height of the plug connector housing 1', the walls 130, 131, 132, 133 are embodied such that they are thin-walled, thereby forming a downwardly open plug connector trough 136 which is rectangular in cross section.

Above the height H, the rear wall 131 is inwardly thickened as far as the boundary area 134 in the transverse direction of the plug connector housing 1', thereby forming a projection 137 whose underside 138 constitutes part of the upper boundary area of the downwardly open plug connector trough 136. The thickened portion forms an upper internal side 139 of the rear wall 131, which constitutes a rear boundary area of contact element chambers 31 formed in the upper part of the plug connector housing. In order to form equally sized contact element chambers 31, a plurality (in this case: three) of thin-walled, planar separating webs 29 extend, in a manner spaced apart regularly from one another, between the upper internal side 139 of the rear wall and an internal side 140 of the front wall in the transverse direction of the plug connector housing 1' from the upper boundary area 134 up to the height H.

The upper internal area 139 and the internal side 140 of the front wall 130 are at a distance from one another which is equal to or slightly greater than the distance between the external sides of the contact arms 8 and 9, with the result that the insulation displacement contact elements 2', 3', 4', **4*a*' can be plugged into a contact element chamber 31**.

The internal areas—bounding the contact element chambers 31 in the longitudinal direction of the plug connector housing 1'—of the side walls 132, 133 and the corresponding separating webs 29 are at a distance from one another which is equal to or slightly greater than the distance between the longitudinal edges 15, 16 of an insulation displacement contact element 2', 3', 4', **4*a*', but is less than the distance between two mutually opposite locking tips 24 of a contact arm 8 or 9, respectively, with the result that an insulation displacement contact element can be plugged into a plug connector housing 1'**—in an interengaging manner captively counter to the feed direction B.

Analogously to the plug connector housing 1 of the first exemplary embodiment, the rear wall 131 of the plug connector housing 1' has, approximately at half the height of each contact element chamber 31, a plug hole 52 in the transverse direction of the plug connector housing 1' and the front wall 130 has a feed hole 141 aligned with the plug hole 52.

Analogously to the plug connector housing 1 of the first exemplary embodiment, the contact element chambers 31 each have a stopper web 160 which runs between the walls (separating webs 29 and/or a side wall 132) bounding the contact element chambers 31 in the longitudinal direction of the plug connector housing 1' and is integrally formed on the walls and, proceeding from the level of the height H, extends a little over the plug hole 52 and/or the feed hole 141 and, in the transverse direction of the plug connector housing 1', is bounded by a respective planar vertical front boundary area 161 and a rear boundary area 122, the front boundary area 161 and the rear boundary area 162 having, in each case with respect to the internal areas 140, 139—opposite the boundary areas 161, 162—of the front wall 130 and of the rear wall 131, respectively, a respective distance which is equal to or preferably somewhat greater than the material thickness of the insulation displacement contact element 2', 3', 4', **4*a*', thereby forming slots 163, 164 through which the contact arms 8, 9 with the contact pins 120, 121 can be plugged and these can project into the plug connector trough 136. A horizontal underside 165—at the level of the height H—of the stopper web 160 forms, in supplementation to the underside 138, the remaining upper boundary area of the plug connector trough 136. The stopper web 160 has a planar upper side 166 which extends parallel to the boundary area 134 somewhat below the upper boundary area 134 and, at its longitudinal edges, is rounded toward the lateral boundary areas 161, 162. The rounded portion preferably has a radius which is greater than the internal radius of the bending zones 5, 6 of the insulation displacement contact elements 2', 3', 4', 4*a*'. In the assembled state, i.e. in the terminally plugged-in state of the insulation displacement contact element 2', 3', 4', 4*a*', the upper side 166 serves as a stop area for the contact arm baseplate 7 and thus defines the maximum plug-in depth of an insulation displacement contact element 2', 3', 4', 4*a*' according to the invention into a plug connector housing 1'** according to the invention.

Furthermore, the stopper web 160 has a plug-through hole 167 which runs in the transverse direction, is aligned with the plug hole 52 and with the feed hole 141 and is of the same size.

In order to facilitate the insertion of the insulation displacement contact elements 2', 3', 4', **4*a*' into a contact element chamber 31, the areas forming a contact element chamber 31 are in each case chamfered toward the upper boundary area 134**, thereby forming an insertion funnel.

On the external side, the feed hole 141 in each case opens into supporting projections 142 which are each integrally formed in one piece on the front wall 130 on the external side. The supporting projections 142 are bounded toward the bottom by a half-hollow-cylindrical bottom area 143 which is open toward the top and is in each case aligned with a feed hole 141. The bottom areas 143, in each case in their two end regions that lead out vertically, merge with planar, vertically running guide areas 144 which each reach beyond the feed hole 141 as far as the upper boundary area 134. In the region above the feed hole 141, the guide areas 144 associated with a contact element chamber 31 are in each case connected to one another at their sides facing the contact element chambers 31 by a half-hollow-cylindrical connecting area 145 that runs vertically, with the result that a guide shaft 146 is formed for each contact element chamber 31. The transition region between a vertical connecting area 145 and the associated upper half-area of a feed hole 141 is [lacuna] with a round transition 147 whose radius R, in cross section (FIG. 6), is preferably equal to or somewhat greater than the radius of a conductor wire 148 to be plugged in. Between the adjacent guide areas 144 of two guide shafts 146 associated with adjacent contact element chambers 31, a respective slotted corner cutout 149 is introduced which runs parallel to the guide areas 144, in each case reaches from the upper boundary area 134 to a point just over the vertical end regions of the bottom area 143 and, in the transverse direction of the plug connector housing 1', reaches from an external area 150 bounding the supporting projections 142 on the external side to a point a little outside the internal area 140 of the front wall 130.

A parallelepipedal cutout 151 corresponding to the corner cutouts 149 in its function is in each case provided in the longitudinal direction of the plug connector housing 1' in each case outside the outermost guide shafts 146. The corner cutouts 149 and the cutouts 151 form resilient shaft cheeks 152 in accordance with the above arrangement in the longitudinal direction of the plug connector housing 1', the internal sides of which cheeks in each case being the guide areas 144.

At the free corner end of the shaft cheeks 152, essentially parallelepipedal latching lugs 153 are in each case integrally formed on each shaft cheek 152, which lugs, on the upper side and on the external side, respectively, in each case terminate flush with the upper boundary area 134 and the external area 150, respectively, and, proceeding perpendicularly from the guide area 144, point a little in the direction of the respective shaft center.

The latching lugs 153 are provided with a chamfer 155 at the transition region between their end area 154 facing the shaft center and the external area 150. The distance between the end areas 154 of two mutually opposite latching lugs 153 is preferably dimensioned to be smaller than the smallest conductor wire 148 that is to be provided with plug connectors according to the invention.

The projection 157 forming the supporting projections 142 has an underside 158 serving as a stop area for a mating plug connector. Analogously to the plug connector housing 1 of the first embodiment, crenellated cutouts are provided at the outer corner region between the underside 158 and the external area 150.

Likewise, analogously to the plug connector housing 1 of the first exemplary embodiment, vertical, channel-shaped trapezoidal cutouts 54 are introduced in the longitudinal direction of the plug connector housing 1' in each case at the level of the plug holes 52 in an upper region of the rear wall 131 which is thickened on the external side.

The method of operation and the assembly sequence of a plug connector according to the invention in accordance with the second embodiment are explained below.

Analogously to the first exemplary embodiment, the plug connectors in accordance with the second exemplary embodiment (FIGS. 4 to 6) are also equipped with insulation displacement contact elements 2', 3', 4', **4*a*', in a preliminarily plugged-in pre-latching position (cf. the two insulation displacement contact elements 2', 3' on the right in FIG. 5, and also FIG. 6). In this position, the plug-in holes 23 in the insulation displacement contact elements 2', 3', 4', 4*a*' are in each case aligned with the holes 141, 167, 52 in the front wall 130, the rear wall 131 and the stopper web 160**, respectively.

In the direction of the arrow A (FIG. 6), as in the first exemplary embodiment, a conductor wire 148 is plugged with its free ends into the plug connector housing 1', with the result that the conductor wire ends do not project beyond the external side of the rear wall 131.

Analogously to the first exemplary embodiment, the insulation displacement contact elements 2', 3', 4', 4*a*' are pressed (direction of arrow B) into their terminally plugged-in position until the contact arm baseplate 7 bears with its underside on the upper side 166 of the stopper web 160. The conductor wire 148 is then held mechanically fixedly and in an electrically contact-connected manner, as in the first exemplary embodiment. In this end position, the contact pins 120, 121 of the insulation displacement contact elements 2', 3', 4', 4*a*', project from above through the slots 164 into the plug connector trough 136.

In addition to the first exemplary embodiment, in the case of a plug connector according to the invention in accordance with the second exemplary embodiment, the conductor wires 148 can be bent over along the direction of the arrow C (FIG. 6) until they rest against the latching lugs 153 of the guide shafts 146. By pressing further on the conductor wires 148, the latter slide along the chamfers 155 of the latching lugs 153 and thus force the resilient shaft cheeks 152 apart, with the result that the conductor wires 148 in each case pass behind the latching lugs 153 into the guide shafts 146. The shaft cheeks 152 then spring back and thus fix the conductor wires 148 in a position bent approximately at right angles. Consequently, it is thus possible, in a simple manner, to produce plug connectors in which the conductor wires 148 are held and contact-connected in a known manner by means of insulation displacement technology and leave the plug connector parallel to the plugging direction B. This is a major advantage in particular under confined space conditions.

It goes without saying that the configuration of a plug connector according to the invention as a single-pole plug connector or plug connector having an arbitrary number of poles also lies within the scope of the invention, the contact element chambers 31 of a plug connector advantageously being arranged in a row next to one another. Furthermore, it is possible, of course, to arrange the conductor wire outgoers alternately on the front side and on the rear side, respectively. Furthermore, it is also possible to form a plug connector according to the invention as a block plug connector from two parallel rows of contact element chambers 31 which are connected to one another in one piece at the respective rear walls, for example.

In an advantageous manner the center planes of the contact element chambers 31 are arranged such that they are spaced apart from one another in the longitudinal direction of a plug connector with a fixed grid dimension, the size of the grid dimension advantageously being 2.5 mm or 5 mm.

If high voltages are to be carried via the plug contact points in specific applications, then it is expedient, moreover, for the contact-making elements 19, 20, 120, 121 of the insulation displacement contact elements 2, 3, 4 and/or 2', 3', 4', 4*a*' in each case to be separated from one another by separating webs 110 in the region of the plug slot of the plug connector trough 136 between the plug cheeks 98, 99, thereby lengthening the offset current creepage paths.

In a further refinement of the invention, it is expedient, for specific applications, for the guide shaft devices of the plug connector housing 1' of the second embodiment to be integrally formed on a plug connector housing 1 of the first embodiment. Furthermore, the plug connector housing 1' in accordance with the second embodiment can, of course, likewise be provide with coding lugs 111 at suitable locations.

Furthermore, in particular a plug connector housing 1 in accordance with the first embodiment is suitable for plugging onto a printed circuit card edge element. For this purpose, however, it is expedient to provide on the plug connector housing 1 latching devices which engage in mating latching devices, for example perforated cutouts, in the printed circuit board and it is thus possible to prevent the plug connector according to the invention from being unintentionally pulled off the printed circuit board.

The invention's configuration of the insulation displacement contact elements allows efficient and simple fabrication since the insulation displacement contact elements have, in the unwound state, merely a narrow sheet-metal strip as the initial form. This enables insulation displacement contact elements to be arranged with small spacings on the transporting and connecting sheet-metal strip that connects the insulation displacement contact elements during the production process using follow-on composite technology. Furthermore, the simple and uncomplicated configuration of the insulation displacement contact element contours means that it is possible to realize a simply constructed stamping tool which is cost-effective to produce and uncomplicated to maintain. Since the shaping work steps during the production of an insulation displacement contact element according to the invention are limited merely to bending operations which, moreover, are all effected about parallel axes, the shaping process is very simple and cost-effective to carry out. The spring hardness of the contact webs 19 can be set as required by individually setting the width of the connection region of the contact webs 19 to the contact spring arms, without having to change the packing density of the insulation displacement contact element blanks on the transporting sheet-metal strip. By virtue of the essentially U-shaped configuration of the insulation displacement contact elements, in a simple manner, a conductor stopper web provided in the plug connector housing can act, in an uncomplicated manner, as a conductor stopper or, as required, also at the same time as an axial stop for the insulation displacement contact element.

A further embodiment of the insulation displacement contact elements 2, 3, 4, is illustrated in FIG. 7 using the example of an insulation displacement contact element 2, 3, 4 in accordance with FIG. 1. It goes without saying that a corresponding configuration of an insulation displacement contact element 2', 3', 4', 4*a*' in accordance with FIG. 5 likewise lies within the scope of the invention.

An insulation displacement contact element 2, 3, 4 according to the invention in accordance with FIG. 7 has, on the longitudinal edges 15, 16, preferably instead of the locking lugs 24, protuberances 170 which are bounded by an arcuate edge 171. The protuberances 170 preferably lie in the plane of the contact spring arms 8*a*, 9*a* and project a little beyond the boundary edges 15 and 16, respectively. The distance between the respective outer points 172 of the protuberances 170 is preferably dimensioned in such a way that the insulation displacement contact element 2, 3, 4 can be plugged in a manner free from play, or with a slight degree of play, into the contact element chambers 31 of a plug connector housing 1 according to the invention. The protuberances 170 primarily serve for guiding the insulation displacement contact element 2, 3, 4 in the contact element chambers 31.

In order to ensure the interlocking and captive retention of such an insulation displacement contact element 2, 3, 4 in both the preliminarily and terminally plugged-in positions, resilient claws 173 are preferably provided. The claws 173 are formed by respective L-shaped incisions 174 in the contact spring arms 8*a*, 9*a*, said incisions proceeding from the longitudinal edge 15, 16. The sheet-metal sections within each L-shaped incision 174 are bent outward, thereby forming in each case a claw edge 175 (FIG. 8) which projects beyond the plane of the contact spring arms 8*a*, 9*a* and points in the direction of the bending zone 5, 6. In the preliminarily and terminally plugged-in states of the insulation displacement contact elements 2, 3, 4, the claw edge 175 interengages in the internal sides 40, 50 of the front wall and of the rear wall, respectively, of the plug connector housing 1, thereby preventing movement of the insulation displacement contact elements 2, 3, 4 counter to the feed direction B.

A mating plug connector 200 (cf. FIGS. 9–13) which corresponds to the plug connector and in which are located mating insulation displacement contact elements 201 corresponding to the insulation displacement contact elements 2, 3, 4 is described below. Parts of identical spatial form and/or identical function are identified by the same reference symbols.

Analogously to the insulation displacement contact elements 2, 3, 4, a mating insulation displacement contact element 201 according to the invention has an insulation displacement contact region 202 for making contact with a conductor wire 213 and a contact-making region 203 for making contact with an insulation displacement contact element 2, 3, 4.

The insulation displacement contact region 202 is constructed analogously to the insulation displacement contact region of an insulation displacement contact element 2 in accordance with FIG. 1, there being provided, in the contact spring arms 8*a*, 9*a*, resilient claws 173 with claw edges 175 and bulges 170 in accordance with FIGS. 7, 8. Contact webs 19' extend in a manner proceeding from the end edges 17, 18, which contact webs initially run toward one another over a stretch in a converging manner and then extend further parallel spaced apart from one another over a stretch. At the free end of the contact webs 19', the latter converge toward one another such that they touch at the free end and form a spreading wedge 204 for the contact spring arms of an insulation displacement contact element 2. Downstream of the spreading wedge 204 in a plugging direction 205, the contact webs 19' are formed such that they bulge in the transverse direction for the purpose of forming a contact zone 206, with the result that the contact webs 19' have an increased bending resistance in the region of the contact zone 206.

The contact webs 19' and the contact zone 206 are thus formed in the manner of a printed circuit board edge contact element.

The mating plug connector 200 according to the invention has a mating plug connector housing 210 with a connection region 212 for conductor wires 213, said connection region having contact element chambers 31 for holding the mating insulation displacement contact elements 201, and a plug receptacle device 214 arranged at one end in an extension of the connection region 212. The plug receptacle device 214 is integrally formed in one piece on the connection region 212.

The connection region 212 of the mating plug connector housing 210 is constructed analogously to the plug connector housing 2 and has a first longitudinal side wall 215, a second longitudinal side wall 216 arranged parallel at a distance, and also, connecting these at the ends, in each case a first side wall 217 and a second side wall 218. In order to form the contact element chambers 31, there are a corresponding number of separating webs (not shown) parallel to the end side walls 218 in a manner dependent on the number of poles of the mating plug connector housing 210. The cross sectional contour of the contact element chambers 31 in the mating plug connector housing 210 is designed to be identical to the cross sectional contour of the contact element chambers 31 of the plug connector housing 1. Analogously to the plug connector housing 1, feed openings 42 are introduced in the first longitudinal side wall 215, which openings widen in a funnel-shaped manner toward the external side. The second longitudinal side wall 216 has plug holes 52 opposite and aligned with the feed holes 42.

The contact element chambers 31 are open at one end and terminated by a cover wall 219 at the other end. The contact element chambers 31 are embodied such that they taper conically with an oblique area 220 in accordance with the converging profile of the contact webs 19' of the mating insulation displacement contact element 201 in the transition region to the cover wall 219. The cover wall 219 has, centrally with respect to each contact element chamber 31, a cutout 221 through which the spreading wedge 204 and the partial regions—running parallel to one another—of the contact webs 19', i.e. the contact zone 206, can be plugged. The cover wall 219 terminates flush with the side walls 217, 218 and in each case projects a little beyond the longitudinal side walls 215, 216 on both sides.

The cover wall 219 simultaneously forms the bottom wall of the plug receptacle device 214, which is formed like a plug shaft in an aligned extension with respect to the contact element chambers 31 of the connection region 12.

The plug receptacle device 214 has a first longitudinal side wall 222, a second longitudinal side wall 223 situated opposite and parallel at a distance, and, in each case connecting these at the ends, a respective first end side wall 224 and a second end side wall 225. The longitudinal side walls 222, 223 and the end side walls 224, 225 bound a cross-sectionally rectangular plug shaft 226 into which a plug connector housing 1 can be plugged. On the external side, the end side walls 224, 225 are each aligned with the end side walls 217, 218, the longitudinal side walls 222, 223 proceeding from those ends of the cover wall 219 which project beyond the longitudinal side walls 215, 216, with the result that the plug receptacle device 214 projects a little beyond the connection region 212 in the transverse direction of the mating plug connector housing 200. The longitudinal side walls 222, 223 and also the end side walls 224, 225 all have the same vertical extent and are each bounded by free upper edges 227, 228, 229, 230 which lie in one plane.

Plug webs 231 are integrally formed approximately transversely centrally with respect to the plug shaft 226 in a manner projecting vertically into the plug shaft 226 from the cover wall 219, which plug webs are each chamfered on their free ends 232 in the longitudinal direction of the plug shaft. The wall thickness of the plug webs 231 is dimensioned to be somewhat smaller than the external dimension of the contact webs 19' with respect to one another in the region of the contact zone 206. The vertical extent of the plug webs 231 into the interior of the shaft is dimensioned in such a way that the free ends of the spreading wedge 214 project a little beyond their free end 232 with mating insulation displacement contact elements 201 fully plugged in (cf. FIG. 13). The plug webs 231 in each case extend between the cutouts 221 in the cover wall 219 and also marginally proceeding from the cutouts 221 as far as the corresponding end side walls 224, 225 with the result that, in the plugged-in state of the mating insulation displacement contact elements 201, the contact webs 19' and the plug webs 231 are arranged such that they are aligned with one another in a manner simulating a printed circuit card edge element.

From the upper edge 227 of the first longitudinal side wall 222, slotted cutouts 235 extend in a manner spaced apart from one another, symmetrically with respect to the longitudinal center plane of the mating plug connector housing 210, over approximately half the height of the first longitudinal side wall 222. In the opposite direction to the slotted cutouts 235, a slotted cutout 236 extends from the cover wall 219 to approximately the level of the free upper edge 227 of the first longitudinal side wall 222 centrally between the slotted cutouts 235, with the result that two latching arm spring webs 237 are cut free from the first longitudinal side wall 222. At their free end, the latching arm spring webs 237 are connected to a latching arm transverse web 238 at which, pointing toward the plug shaft 226, a latching lug 239 is arranged which has a latching edge 240 pointing toward the cover wall 219 and an oblique area 241 pointing away from the plug shaft 226. The latching lug 240 interacts with the latching edge 57 in the plug connector housing 1 of a corresponding plug connector, with the result that after a plug connector housing 1 has been plugged together with a corresponding mating plug connector housing 210, these are fixed in a releasably latching manner with respect to one another.

Adjacent to the slotted cutout 238, web projections 243 corresponding to the slots 108, 109 in the plug connector housing 1 are integrally formed on the internal side of the first longitudinal side wall 222, which web projections are formed such that they are bevelled toward the open plug shaft side.

A U-shaped cutout 244, which extends longitudinally centrally symmetrically with respect to the mating plug connector housing 210 over almost the entire longitudinal wall 223 and is bounded by a bottom edge 245 and two side edges 246, is introduced in the second longitudinal side wall 223 opposite the first longitudinal side wall 222. Coding webs 247 extend from the bottom edge 245 as far as the plug shaft bottom, said coding webs being arranged in a manner corresponding to the coding lugs 111 on the plug connector housing 1. Furthermore, with the plug connector housing 1 plugged in, the bottom boundary edge 245 of the cutout 244 interacts with the stop lugs 247 of said housing and thus forms a plug boundary in the plugging direction 205.

A mating plug connector 200 according to the invention is equipped with mating insulation displacement contact elements 201 in an analogous manner to the plug connector.

In order to connect conductor wires 213 to the mating plug connector 200, firstly all the mating insulation displacement contact elements 201 are situated in a preliminarily plugged position (cf. FIG. 12), in which the conductor wire end is plugged through the feed openings 42. In this position, the spreading wedge 204 precisely reaches through the cover wall 219. After the insertion of the conductor wire end 213, the mating insulation displacement contact elements 201 are shifted counter to the plugging direction 205 into their terminally plugged position, the insulation displacement contact thereby being formed. In the terminally plugged plug position of the mating insulation displacement contact element 201, the free ends of the contact webs 19 precisely project beyond the free ends of the plug webs 231. In this position, the plug webs 231 and the contact webs 219 form, together with the spreading wedges 204, a mating plug element for a plug connector housing 1 which is formed in the manner of a printed circuit board edge element.

What is claimed is:

1. An electrical plug connector comprising at least one plug connector housing (1, 1') and at least one insulation displacement contact element (2, 3, 4 and/or 2', 3', 4', **4*a*') that can be plugged into the plug connector housing (1, 1') and comprises a sheet-metal stamping, which element has a planar contact arm baseplate (7), on which, on mutually opposite edges, a first contact plate (8, 8*a*) and a second contact plate (9, 9*a*) are integrally formed in one piece in a manner such that they are bent away in the same direction via a respective bending zone (5, 6), the contact plates (8, 9 and/or 8*a*, 9*a*) each having an insulation displacement contact device (21) for a conductor wire (148), and contact-making elements (19, 20 and/or 120, 121) for forming a contact-making device for making releasably pluggable contact with a mating plug contact element being provided on the insulation displacement contact element (2, 3, 4 and/or 2', 3', 4', 4*a*') the contact plates (8, 8*a*, 9, 9*a*) comprising contact spring arms in which the insulation displacement contact device (21) is arranged in the bending zone region, the contact spring arms having longitudinal edges (15, 16), said contact device being located so as to adjoin at least on one contact spring arm (8, 8*a*, 9, 9*a*), an element (19, 20 and/or 120, 121) of the contact-making device, the insulation displacement device (21) being keyhole-shaped, with a narrow insulation displacement contact slot (22) in the vicinity of the bending zone, the slot (22) running transversely centrally parallel to the longitudinal edges (15, 16) and opening into a plug-in hole (23) in a vicinity of the contact-making elements (19, 20 and/or 120, 121**).

2. The electrical plug connector as claimed in claim 1, wherein the two contact plates (8, 9) are formed as first and second contact spring arm (**8*a*, 9*a*) on whose free ends the contact-making elements (19, 20**) are integrally formed.

3. The electrical plug connector as claimed in claim 1, wherein the contact-making elements (19, 20) are contact webs (19) with a bending zone (20), the contact webs (19) of the contact spring arms (**8*a*, 9*a*) initially converging and, below the bending zone (20), diverging in a piece, with the result that the bending zones (20**) of the contact-making devices make contact with the mating plug contact element.

4. The electrical plug connector as claimed in claim 1, wherein the contact-making elements (120, 121) are contact pins (120, 121) which are integrally formed on at least one of the contact arms (8, 9).

5. The electrical plug connector as claimed in claim 1, wherein the contact-making elements (19, 20 and/or 120, 121) are arranged in an extension of the contact spring arms (**8*a*, 9*a*) and/or of the contact arms (8, 9**).

6. The electrical plug connector as claimed in claim 1, wherein the contact-making elements (120, 121) are contact pins (120, 121) which are formed by a slotted cutout (122) in a planar extension of one of the contact arms (8, 9).

7. The electrical plug connector as claimed in claim 1, wherein the contact arms (8, 9) and/or the contact spring arms (**8*a*, 9*a*) are bent away at right angles to the contact arm baseplate (7) and/or to the spring arm baseplate (7*a***), thereby forming a cross-sectionally U-shaped insulation displacement contact element.

8. The electrical plug connector as claimed in claim 1, wherein devices (24, 173) are present which captively retain the insulation displacement contact element in a position plugged preliminarily into a contact element chamber (31) of the plug connector housing (1, 1') and/or in a terminally plugged-in position in the contact element chamber (31).

9. The electrical plug connector as claimed in claim 1, wherein the contact arms (8, 9) and/or the contact spring arms (**8*a*, 9*a*) are embodied identically at least in a region on a plugging side of the electrical plug connector after the contact-making devices (120, 121 and/or 19, 20) and the insulation displacement contact elements (2', 3', 4', 4***a*' and/or 2, 3, 4), in this region, are formed mirror-symmetrically with respect to a plane running parallel to the contact arms (8, 9) and/or the contact spring arms (8*a*, 9*a*) and passing transversely centrally through the contact arm baseplate (7) and/or spring arm baseplate (7*a*), and a plane passing at right angles thereto longitudinally centrally through the contact arm baseplate (7) and/or spring arm baseplate (7*a*).

10. The electrical plug connector as claimed in claim 1, wherein the plug connector housings (1, 1') each have side walls (27, 28) and contact element chambers (31) which are open parallel to the side walls (27, 28) and into which the insulation displacement contact elements (2, 3, 4 and/or 2', 3', 4' 4*a*') can be plugged.

11. The electrical plug connector as claimed in claim 1, wherein the contact arm baseplate (7) and/or the spring arm baseplate (7*a*) has, at right angles to the two bending zones (5, 6), free side edges (10, 11), each of the free side edges (10, 11) having a longitudinal center in which supporting projections (12) are integrally formed.

12. The electrical plug connector as claimed in claim 1, wherein the contact arms (8, 9) and/or the contact spring arms (8*a*, 9*a*) are in each case somewhat wider than the contact arm baseplate (7) and/or the spring arm baseplate (7*a*) including the supporting projections (12) and have, on both sides of the bending zone (5, 6), a projecting short end edge (13, 14) and also longitudinal edges (15, 16), adjoining the end edges (13, 14) at right angles, and short end edges (17, 18) projecting back at right angles.

13. The electrical plug connector as claimed in claim 1, wherein the plug connector housing (1) is embodied in an essentially parallelepipedal form and has a front wall (25), a rear wall (26) running parallel at a distance from the front wall (25) in a longitudinal direction, a first side wall (27), a second side wall (28) and, parallel to the side walls (27, 28), separating webs (29, 30) running parallel and at a distance from said side walls.

14. The electrical plug connector as claimed in claim 1, wherein the insulation displacement contact elements (2, 3, 4 and/or 2', 3', 4', 4*a*') are held captively in a preliminarily plugged-in position.

15. The electrical plug connector as claimed in claim 1, wherein conductor wire outgoers are arranged alternately on a front side and rear side, respectively, of the plug connector housing (1, 1').

16. The electrical plug connector as claimed in claim 1, wherein a plug connector housing (1, 1') comprises parallel rows of contact element chambers (31) which are connected to one another in one piece at respective rear walls and thus form a block plug connector.

17. A mating plug connector for plug-in connectors as claimed in claim 1, comprising a mating plug connector housing (210) and at least one insulation displacement contact element (201) that can be plugged into the mating plug connector housing (210) and comprises a sheet-metal stamping, which element has a contact baseplate (7*a*), on which, on mutually opposite edges, a first contact plate (8*a*) and a second contact plate (9*a*) are integrally formed in one piece in a manner such that they are bent away in the same direction via a respective bending zone (5, 6), the contact plates (8*a*, 9*a*) each having an insulation displacement contact device (21) for a conductor wire (148), and contact webs (19) for forming a contact-making device for making releasably pluggable contact with a plug contact element being provided on the insulation displacement contact element (201), wherein the contact webs (19') form a contact zone (206), such that the mating insulation displacement contact element (201) has contact zones (206) which are formed in the manner of a printed circuit board edge contact element and projecting into the plug receptacle device (214).

18. The electrical plug connector as claimed in claim 8, wherein the devices (24) which captively retain the insulation displacement contact element are locking tips (24) which are integrally formed on the insulation displacement contact element (2, 3, 4 and/or (2', 3', 4', 4*a*'), are e.g. in the form of barbs and are arranged on the longitudinal edges (15, 16).

19. The electrical plug connector as claimed in claim 8, wherein the devices (173) which captively retain the insulation displacement contact element are claws (173) which are integrally formed on the insulation displacement contact element (2, 3, 4 and/or 2', 3', 4', 4*a*'), project from the extending planes of the contact arms (8, 9) and/or of the contact spring arms (8*a*, 9*a*) and have a claw edge (175) which points in the direction of the bending zones (5, 6).

20. The electrical plug connector as claimed in claim 8, wherein the electrical plug connector is embodied in a single-pole manner or with an arbitrary number of poles, the contact element chambers (31) being arranged in a row next to one another in the case of a multipole embodiment.

21. The electrical plug connector as claimed in claim 8, wherein the contact element chambers (31) have center planes which are arranged such that they are spaced apart from one another in the longitudinal direction of a plug connector (1, 1') with a fixed grid dimension, in particular a grid dimension of 2.5 or 5 mm.

22. The electrical plug connector as claimed in claim 10, wherein the plug connector housing (1) has, in a region below the contact element chambers (31), a plug slot, formed from plug cheeks (98, 99) for contact-making plugging onto a printed circuit board edge element.

23. The electrical plug connector as claimed in claim 10, wherein the plug connector housing (1') has, in a region below the contact element chambers (31), a downwardly open plug connector trough (136) for receiving a mating plug connector.

24. The electrical plug connector as claimed in claim 10, wherein each contact element chamber (31) has a cross-sectionally H-shaped spatial form.

25. The electrical plug connector as claimed in claim 10, wherein each of the contact element chambers (31) has a longitudinal extent which is dimensioned in such a way that an insulation displacement contact element (2, 3, 4 and/or 2', 3', 4', 4*a*') can be plugged in with longitudinal edges (15, 16) in a manner free from play or with a slight degree of play, but the locking tips (24) penetrate a little into the housing material in an interlocking manner and the insulation displacement contact element (2, 3, 4 and/or 2', 3', 4', 4*a*') is thus held in a positively locking manner and captively.

26. The electrical plug connector as claimed in claim 13, wherein the front wall (25) has feed holes (42) which penetrate the front wall (25) approximately in a middle of a height of the front wall (25) and serve for plugging in a conductor wire with which contact is to be made, each of the holes (42) being assigned to a contact element chamber (31) and opening centrally into said chamber, the feed holes (42) being formed such that they are expanded in a funnel-shaped manner toward an external side (41) of the front wall (25).

27. The electrical plug connector as claimed in claim 13, wherein the side walls (27, 28) and the separating webs (29, 30) have, centrally in the transverse direction, a respective rectangular thickened portion (61, 62) running in a transverse direction, which thickened portions extend approximately over half of a transverse extent of each of the side walls (27, 28) and each have an internal area (63) facing the contact element chambers (31) and side areas running at a distance from and parallel to internal sides (40, 50) of the front and rear walls and bounding the thickened portions (61, 62) in the transverse direction, with the result that a narrow plug groove (66, 67) is in each case formed between the internal sides (40, 50) and the side areas.

28. The electrical plug connector as claimed in claim 26, wherein the rear wall (26) in each case has plug holes (52) for plugging in conductor wires, the plug holes (52) corresponding to the feed holes (42) and having approximately the same diameter.

29. The electrical plug connector as claimed in claim 28, wherein the rear wall (26) has a wall thickness and that has, above each of the plug holes (52), a parallelepipedal latching cutout (56) whose longitudinal extent corresponds approximately to a longitudinal extent of a corresponding one of the contact element chambers (31) and whose transverse extent corresponds approximately to half a wall thickness of the rear wall (26), the latching cutout (56) having a latching edge (57) for latching with a mating latching device of a mating plug housing.

30. The electrical plug connector as claimed in claim 28, wherein a thin-walled web (80) runs between two thickened portions of a contact element chamber (31), centrally in a transverse direction, connecting them as a conductor stopper web, and an upper boundary edge (81) of the web (80) is formed such that it is half-round, concave and aligned with the feed holes (42) of the front wall (25) and the plug holes (52) in the rear wall (26).

31. The electrical plug connector as claimed in claim 30, wherein the stopper web (80, 160) extends a little beyond the plug hole (52) and/or the feed hole (141) and has a plug-through hole (167) which runs in the transverse direction, is aligned with the plug hole (52) and with the feed hole (141) and is of the same size.

32. The electrical plug connector as claimed in claim 31, wherein an upper side (166) of the stopper web (160) acts as a stop area for the contact arm baseplate (7) and thus delimits a maximum axial plug-in depth of the insulation displacement contact element (2', 3', 4', **4*a*') into the plug connector housing (1'**).

33. The electrical plug connector as claimed in claim 13, wherein the feed hole (42, 141), on the external side, in each case opens into supporting projections (142) which are each integrally formed in one piece on the front wall (130) and are bounded by a half-hollow-cylindrical bottom area (143) which is open toward the top and is in each case aligned with a feed hole (141).

34. The electrical plug connector as claimed in claim 13, further comprising a front plug cheek (90) and a rear plug cheek (91) which are integrally formed in an extension of the front wall (25) and of the rear wall (26), respectively, on the latter in a manner running downward from a lower edge (38) of the side walls.

35. The electrical plug connector as claimed in claim 34, wherein the plug cheeks (90, 91) each have an external side (92, 93), which are aligned with external sides of the front and rear walls, respectively, in regions below stop steps of the front and rear walls, respectively.

36. The electrical plug connector as claimed in claim 33, wherein the bottom areas (143), in their two end regions that in each case lead out vertically, merge with planar guide areas (144) which run vertically, in each case reach beyond the feed hole (141) as far as the upper boundary area and, in the region above the feed hole (141), are in each case connected to one another at their sides facing the contact element chambers (31) by a half-hollow-cylindrical connecting area (45) that runs vertically, with the result that a guide shaft (146) is formed for each contact element chamber (31).

37. The electrical plug connector as claimed in claim 34, wherein outwardly protruding coding lugs (111) are integrally formed in a region of a lower third of an external side (92) of the front plug cheek (90), which lugs can be separated from the plug connector housing (1), and a predeterminable coding pattern can be set by separating by one or more coding lugs (111).

38. The electrical plug connector as claimed in claim 34, herein the plug cheeks (90, 91) have an internal side (94, 95) which runs parallel to a longitudinal direction and is in each case arranged inwardly offset a little in a transverse direction relative to internal sides of the front and rear walls, respectively, thereby producing the plug slot for a mating plug element.

39. The electrical plug connector as claimed in claim 38, wherein the internal sides (94, 95) each have, centrally in the longitudinal direction with respect to a contact element chamber (31), a pocket-like, parallelepipedal shallow depression (100) which in each case reaches from the level of the lower edge (38) to a point just above a lower boundary edge (96 and 97, respectively).

40. The mating plug connector as claimed in claim 17, wherein the mating plug connector housing (210) is formed in a multipole manner with a plurality of mating insulation displacement contact elements (201) which have a standardized grid spacing, in particular a grid spacing of 2.5 mm or 5 mm, with respect to one another.

41. The mating plug connector as claimed in claim 17, wherein plug webs (231) are arranged between the contact zones (206) of the mating insulation displacement contact elements (201) and form, together with the contact zones (206), a plug/contact device in the manner of a printed circuit board edge element.

42. The mating plug connector as claimed in claim 17, wherein contact element chambers (31) for receiving mating insulation displacement contact elements (201) are arranged in the connection region (212) of the mating plug connector housing (210), it being possible for the mating insulation displacement contact elements (201) to be fixed in a preliminarily and a terminally plugged-in position.

43. The mating plug connector as claimed in claim 17, wherein the mating insulation displacement contact element (201) has an insulation displacement contact region (202) for making contact with a conductor wire (213) and a contact-making region (203) for making contact with an insulation-displacement contact element (2, 3, 4), the insulation displacement contact region (202) having, in its contact spring arms (**8*a*, 9*a*), resilient claws (173) with claw edges (175) and bulges (170**).

44. The mating plug connector as claimed in claim 17, wherein the plug receptacle device (214) is formed as a plug shaft (226) which is connected to the connection region (212) in one piece.

45. The mating plug connector as claimed in claim 42, wherein the connection region (212) of the mating plug connector housing (210) has a first longitudinal side wall (215) with feed openings (42), a second longitudinal side wall (216) arranged parallel at a distance, and also, connecting these at the ends, in each case a first side wall (217) and a second side wall (218), in which case, in order to form the contact element chambers (31), there are a corresponding number of separating webs parallel to end ones of the side walls (218) in a manner dependent on a number of poles of the mating plug connector housing (210).

46. The mating plug connector as claimed in claim 17, wherein the contact webs (19') extend in a manner proceeding from the end edges (17, 18), which contact webs initially run toward one another over a stretch in a converging manner and then extend parallel spaced apart from one another over a stretch on as far as their free end, where they run toward one another in a manner such that they touch and form a spreading wedge (204) for the contact spring arms of an insulation displacement contact element (2).

47. The mating plug connector as claimed in claim 46, wherein downstream of the spreading wedge (204) in a plugging direction (205), the contact webs (19') are formed such that they bulge in the transverse direction for the purpose of forming a contact zone (206), with the result that the contact webs (19') have an increased bending resistance in the region of the contact zone (206).

48. The mating plug connector as claimed in claim 46, wherein plug webs (231) are integrally formed approximately transversely centrally with respect to the plug shaft in a manner projecting vertically into the plug shaft (226) from the cover wall (219), which plug webs have free ends (232) and are each chamfered on their free ends (232) in a longitudinal direction of the plug shaft, and a wall thickness of the plug webs (231) is dimensioned to be somewhat smaller than an external dimension of the contact webs (19') with respect to one another in a region of the contact zone (206), the plug webs (231) having a vertical extent into the interior of the shaft which is dimensioned in such a way that free ends of the spreading wedge (204) project a little beyond the free ends (232) of the plug webs with mating insulation displacement contact elements (201) fully plugged in.

49. The mating plug connector as claimed in claim 48, wherein the plug webs (231) in each case extend between the cutouts (221) in the cover wall (219) and also marginally proceeding from the cutouts (221) as far as the corresponding end side walls (224, 225) with the result that, in the plugged-in state of the mating insulation displacement contact elements (201), the contact webs (19') and the plug webs (231) are arranged such that they are aligned with one another in a manner simulating a printed circuit card edge element.

* * * * *

UNITED STATES PATENT AND TRADEMARK OFFICE

CERTIFICATE OF CORRECTION

PATENT NO. : 6,616,476 B1 
DATED : September 9, 2003
INVENTOR(S) : Werner Moritz, Roland Wittenberg and Robert Schneider It is certified that error appears in the above-identified patent and that said Letters Patent is hereby corrected as shown below:

Title page,
Item [*] Notice, change the Notice to read:
-- Subject to any disclaimer, the term of this patent is extended or adjusted under 35 U.S.C. 154(b) by 52 days. --

Signed and Sealed this

Thirteenth Day of January, 2004

JON W. DUDAS
*Acting Director of the United States Patent and Trademark Office*